US011291301B2

(12) United States Patent
Bova et al.

(10) Patent No.: US 11,291,301 B2
(45) Date of Patent: Apr. 5, 2022

(54) MODULAR FLAT-PACK APPARATUS FOR CUSTOMIZABLE CABINETRY FRAMING

(71) Applicant: New England Welding, Inc., Avon, MA (US)

(72) Inventors: Salvatore Bova, Plymouth, MA (US); Kenneth McIntire, West Bridgewater, MA (US); Eric Chuckran, Mashpee, MA (US)

( * ) Notice: Subject to any disclaimer, the term of this patent is extended or adjusted under 35 U.S.C. 154(b) by 0 days.

(21) Appl. No.: 15/969,750

(22) Filed: May 2, 2018

(65) Prior Publication Data

US 2018/0317650 A1 Nov. 8, 2018

Related U.S. Application Data

(60) Provisional application No. 62/500,009, filed on May 2, 2017.

(51) Int. Cl.

| | |
|---|---|
| ***A47B 47/02*** | (2006.01) |
| ***A47B 45/00*** | (2006.01) |
| ***A47B 47/00*** | (2006.01) |
| ***A47B 77/08*** | (2006.01) |

(52) U.S. Cl.

CPC ..... *A47B 47/027* (2013.01); *A47B 45/00* (2013.01); *A47B 47/0008* (2013.01); *A47B 77/08* (2013.01); *A47B 47/0091* (2013.01)

(58) Field of Classification Search

CPC ... A47B 47/027; A47B 45/00; A47B 47/0008; A47B 77/08; A47B 47/0091; A47B 96/025; A47B 46/00; A47B 47/00; A47B 43/00; A47B 47/0083; A47F 5/0093; A47F 5/10; H05K 7/1488; H05K 7/18; H02B 1/013; H02B 1/01

USPC ..... 312/265.1, 265.4, 205, 107, 257.1, 108; 211/175, 208, 182, 186, 189, 195, 207, 211/201

See application file for complete search history.

(56) References Cited

U.S. PATENT DOCUMENTS 642,561 A * 1/1900 Phillips ..... A47B 45/00 211/175
3,229,790 A * 1/1966 Shayne ..... F16B 12/50 403/172

(Continued)

*Primary Examiner* — Hiwot E Tefera
(74) *Attorney, Agent, or Firm* — Matthew M. Yospin

(57) ABSTRACT

Systems and methods are provided for customizable cabinetry framing. The systems presented describe components which can be assembled into customizable framing modules for cabinetry in outdoor kitchens, farming sheds, restaurants, warehouses, or more. The methods presented describe making each component by cutting sheet metal or other sheet material, and then by folding the cut sheet metal, and using some fasteners. Standardized components may be assembled on-site into customized modules. These materials and assembly eliminate the need for costly and time-consuming welding at point of manufacture or assembly, while providing advantages in strength of the assembled framing modules. Various components may be packed for shipping in relatively flat units. The present invention solves problems with the currently available means of manufacturing and assembling outdoor kitchens and other custom framing built on-site. Lower costs of materials, manufacture, shipping, and labor for assembly result in more cost-effective and/or stronger framing.

1 Claim, 22 Drawing Sheets

(56) References Cited

U.S. PATENT DOCUMENTS 3,871,784 A * 3/1975 Van Horn ..... F16B 7/0486 403/236
3,955,511 A * 5/1976 Bak ..... A47B 45/00 108/137
4,261,470 A * 4/1981 Dolan ..... F16B 12/36 108/55.1
5,014,954 A * 5/1991 Merl ..... F16M 11/10 211/105.3
5,016,893 A * 5/1991 Hart, Jr. ..... B62B 3/10 211/195
5,439,152 A * 8/1995 Campbell ..... B60R 9/00 108/55.1
6,123,208 A * 9/2000 Haenszel ..... A47B 45/00 108/55.1
6,516,732 B1 * 2/2003 LaCombe ..... A47B 45/00 108/153.1
6,854,238 B2 * 2/2005 Boots ..... A47B 47/027 403/176
7,097,053 B1 * 8/2006 Karl ..... A47B 57/04 211/186
7,113,762 B1 * 9/2006 Hertz ..... H05K 7/1488 361/600
7,717,376 B2 * 5/2010 Sparks, Jr. ..... F16B 7/18 248/145
8,348,071 B1 * 1/2013 Janlert ..... F16M 5/00 211/175
8,695,815 B2 * 4/2014 Takahashi ..... H05K 7/1432 211/182
9,872,573 B1 * 1/2018 Yates ..... A47B 46/005
9,877,577 B2 * 1/2018 Knighton ..... B62B 3/005
10,143,298 B2 * 12/2018 Wood ..... F16B 12/40
10,548,398 B2 * 2/2020 Butler ..... A47B 31/02
11,064,803 B2 * 7/2021 Watts ..... A47B 47/03
2003/0155319 A1 * 8/2003 Wishart ..... A47B 47/027 211/189
2011/0074258 A1 * 3/2011 Takahashi ..... H05K 7/1432 312/223.1
2014/0190910 A1 * 7/2014 Arflack ..... H05K 7/1488 211/26
2015/0173508 A1 * 6/2015 Ma ..... A47B 45/00 211/208
2017/0164734 A1 * 6/2017 Steele ..... F16B 12/50

* cited by examiner

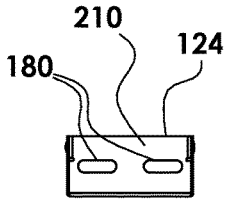
FIG. 9
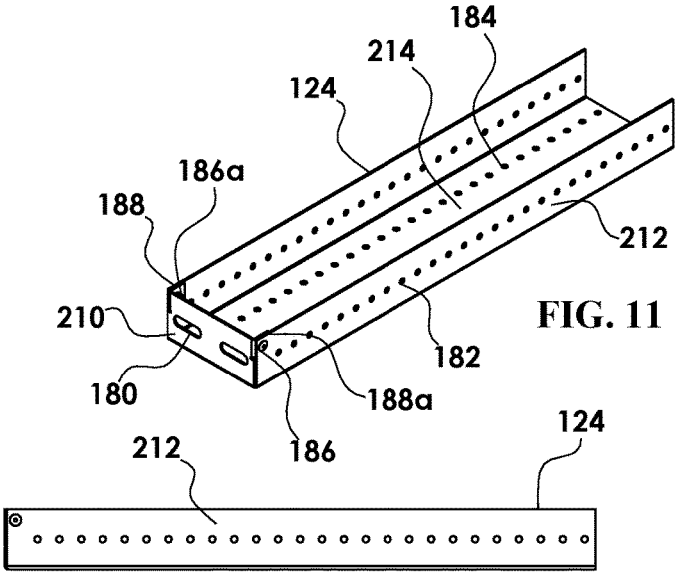
FIG. 11
FIG. 10
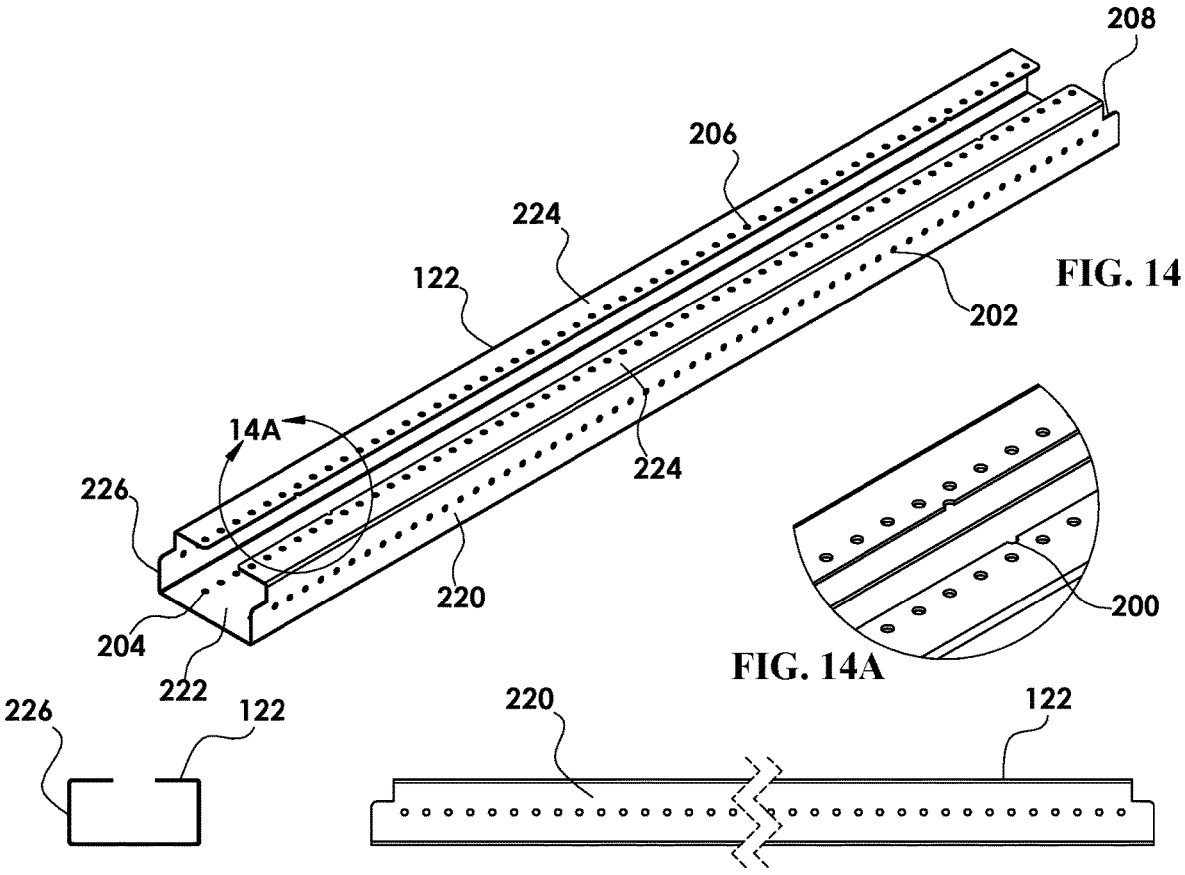
FIG. 14
FIG. 14A
FIG. 12
FIG. 13

MODULAR FLAT-PACK APPARATUS FOR CUSTOMIZABLE CABINETRY FRAMING

FIELD OF THE INVENTION

The presently disclosed subject matter relates to providing modular and customizable framing for outdoor kitchens and other uses of customizable cabinetry framing.

BACKGROUND OF THE INVENTION

Builders and craftsmen have been making custom cabinetry framing for centuries, and various solutions have been proposed to lower the cost of materials and labor. Cabinetry framing is typically expensive to build and install due to the cost of labor, because nearly every installation requires some customization in fitting materials or parts to the desired job site to build the desired cabinetry framing. There is a relation between cost of labor and cost of materials in building custom cabinetry framing: low materials costs, such as for wood framing, typically require more time to plan, cut, and assemble, leading to increased labor costs. Additionally, such solutions can be plagued by inconsistent quality of the construction, leading to weak structures, parts that don't fit, or leaks. To make custom cabinetry framing that is weatherproof such that it can be used outdoors, some builders have used materials such as drywall studs, which may be easily cut and fastened together—but such a product is very likely not structurally sound enough to support heavy materials, such as concrete backing board, stonework, stone countertops, sinks, and grills.

Conversely, labor costs can be lowered by building custom cabinetry in a factory, and build quality can be high, but the costs for materials, storage, and shipping will all very likely increase dramatically. Custom cabinetry, and whether pre-fabricated or built-to-order, generally contains many unique parts, driving up both supply chain complexity and cost, cost of assembly, and cost of packing. Furthermore, pre-fabricated custom cabinetry will present far fewer choices for the builder and end user in what they can install and how they can use the space where they want to install the custom cabinetry, if the factory produces only a few modules. Alternatively, the factory costs for the pre-fabricated modules will be high, if the factory maintains assembly lines and plans for a wide range of pre-fabricated modules. Whether a factory's pre-fabricated framing modules present a problem of few choices and/or a problem of especially high costs for offering many pre-fabricated modules, the costs for materials, storage, and shipping will remain a problem for builders and end users.

Additionally, pre-fabricated modules assembled in a factory pose other logistical and purchasing problems for builders and end users. Pre-fabricated modules are large, and therefore stocking them in a store or warehouse is expensive: it requires a relatively large amount of storage space, and also ties up capital in a relatively expensive product. One solution companies have used is to not manufacture a large supply in advance, and only make them when orders come in—but that can lead to supply chain problems and delays in delivery. Thus, pre-fabricated cabinetry modules have problems with cost, supply chain, and delivery. While there are available from at least on manufacturer pre-fabricated component parts for custom cabinetry frameworks that may be flat-packed for shipping, such items have some of the same problems that exists with fully-assembled pre-fabricated custom cabinetry solutions: they have components that are not interchangeable, so that each different module requires a different set of parts; and the components are not adjustable, so that the assembled module may not be customized for height, width, or both, leading to a limitation on the marketability of the modules so made. One shortcoming that results from this failure of customizability is that one cannot simply buy and use any available finishing materials, or other hardware. For instance, cabinet doors, or drawers, or shelving or sliding units, or trash bins, or sinks or grills, may need to be purchased from a particular manufacturer, or from a limited set of the options available on the market, because the cabinetry framework will only accept hardware and finishes of particular heights and widths. Furthermore, because the existing state of the art in flat-pack modular cabinetry frameworks requires a broad array of components, the sunk costs of manufacturing, warehousing, and shipping the packaged kits will be high for the manufacturer, warehouse, and shipper.

Custom framing can sometimes be made more cheaply by sacrificing quality and build strength, but trading safety and durability for cost is a poor compromise. This is the current state of custom cabinetry framing: good and expensive, or poor and cheap. Accordingly, a market need exists for high-quality and high-strength cabinetry framing that can be customized on-site, shipped and stocked in stores at relatively low costs, and assembled with relatively low labor costs.

SUMMARY OF THE INVENTION

The present invention meets all these needs, by disclosing apparatus and methods for modular cabinetry framing components. The goal of the present invention is to provide a solution for modular cabinetry framing, which framing may be customized on-site for a wide range of desired uses. The present invention provides for apparatus that may be made in a production facility, packed in relatively flat boxes for warehousing, shipping, or distribution, and assembled on-site easily, by builders, contractors, or end users. The apparatus comprises modules which may be assembled on-site from a small set of types of components, which components may be used in various ways and combinations to make different modules. The components so produced, and the modules assembled from those components, are strong due to the materials used and methods of assembly, and relatively affordable due to the ability to mass-produce standard components which can be assembled into custom configurations. The customized modular cabinetry modules so produced are also relatively affordable due to the ability to ship them and stock them in relatively compact containers. Thus, the present invention also provides for increased choice of types of modules relative to pre-fabricated whole modules, because the components can be adjusted and sized to fit particular desired installations. Additionally, the present invention discloses apparatus and methods for assembling multiple different types of modules for cabinetry framing, which different types of modules may be assembled from a relatively small number of types of components, assembled in different structures, keeping down production, packing, and shipping costs. In this way, the present invention presents improvements in consumer choice and options for builders and end users, in what they can custom build or have custom built, and in the quality and cost of the finished cabinetry frames. Moreover, the adjustability of the modular cabinetry frameworks assembled from the present invention allow a range of adjustment for, first, the height, width, and depth of the tops of the modules so that the modules may accommodate grills, sinks, and other hardware, in a wide range of sizes; and second, the height and width of the faces (the sides) of the modules so that the modules may accommodate accessories such as door, drawers, or shelf structures in a wide range of sizes, which accessories are to be installed in or on the cabinetry frameworks with the opening size of the framework adjusted independently of the top opening of the module. With these independent adjustments of the inventive modules, the user has far more flexibility in what they can buy and use than with the currently existing art of outdoor modular cabinetry framework.

These aspects of the present invention, and others disclosed in the Detailed Description of the Drawings, represent improvements on the current art. This summary is provided to introduce a selection of concepts in a simplified form that are further described below in the Detailed Description of the Drawings. This Summary is not intended to identify key features or essential features of the claimed subject matter, nor is it intended to be used to limit the scope of the claimed subject matter.

BRIEF DESCRIPTION OF THE DRAWINGS

The foregoing summary, as well as the following detailed description of various embodiments, is better understood when read in conjunction with the appended drawings. For the purposes of illustration, the drawings show exemplary embodiments; but the presently disclosed subject matter is not limited to the specific methods and instrumentalities disclosed. In the drawings, like reference characters generally refer to the same components or steps of the device throughout the different figures. In the following detailed description, various embodiments of the present invention are described with reference to the following drawings, in which:

FIG. 9 shows a front elevation view of the distal end of an end slide, one of the parts of an adjustable horizontal channel.

FIG. 10 shows a side elevation view of an end slide, one of the parts of an adjustable horizontal channel.

FIG. 11 shows a perspective view of an end slide, one of the parts of an adjustable horizontal channel.

FIG. 12 shows a front elevation view of an end of a horizontal channel sleeve, one of the parts of an adjustable horizontal channel.

FIG. 13 shows a side elevation view of a horizontal channel sleeve, one of the parts of an adjustable horizontal channel.

FIG. 14 shows a perspective view of a horizontal channel sleeve, one of the parts of an adjustable horizontal channel.

FIG. 14A presents a perspective view detail of half-round notches in a horizontal channel sleeve.

DETAILED DESCRIPTION OF THE DRAWINGS

The presently disclosed invention is described with specificity to meet statutory requirements. But, the description itself is not intended to limit the scope of this patent. Rather, the claimed invention might also be embodied in other ways, to include different steps or elements similar to the ones described in this document, in conjunction with other present or future technologies. Moreover, although the term "step" or similar terms may be used herein to connote different aspects of methods employed, the term should not be interpreted as implying any particular order among or between various steps herein disclosed unless and except when the order of individual steps is explicitly described.

In the following description, numerous specific details are set forth to provide a thorough understanding of the invention. But, the present invention may be practiced without these specific details. Structures and techniques that would be known to one of ordinary skill in the art have not been shown in detail, in order not to obscure the invention. Referring to the figures, it is possible to see the various major elements constituting the apparatus and methods of the present invention.

The present invention comprises novel apparatuses of, and methods for, modular flat-pack customizable cabinetry framing. Using a small set of standardized parts, referred to herein as components, of the present invention, one (a user or assembler using the apparatus and methods of the present invention) may assemble and customize a variety of modules of cabinetry framing. In the present disclosure, a module comprises a plurality of components. Some of the exemplary modules may be customized as to width when they are assembled, and certain of the modules may customized as to depth and/or height of certain openings in those modules, to be used for holding or supporting various objects, as is described in further below. Other exemplary modules of the present invention are not adjustable as to width, and are shipped with one-piece non-adjustable horizontal channels, not the adjustable horizontal channels described later in the present disclosure. Various of the modules may be attached to other modules and/or to the ground, floor, or platform that supports them, for strength and for stability. While various of such modules are described below with specificity, these descriptions are not to be taken to limit the modules that may be made with the components to only the described modules. Furthermore, while the various modules are referred to with certain phrases, it is to be understood that a particular module may be used or assembled for other purposes.

MODULE: grill module 10.

Figure 1:
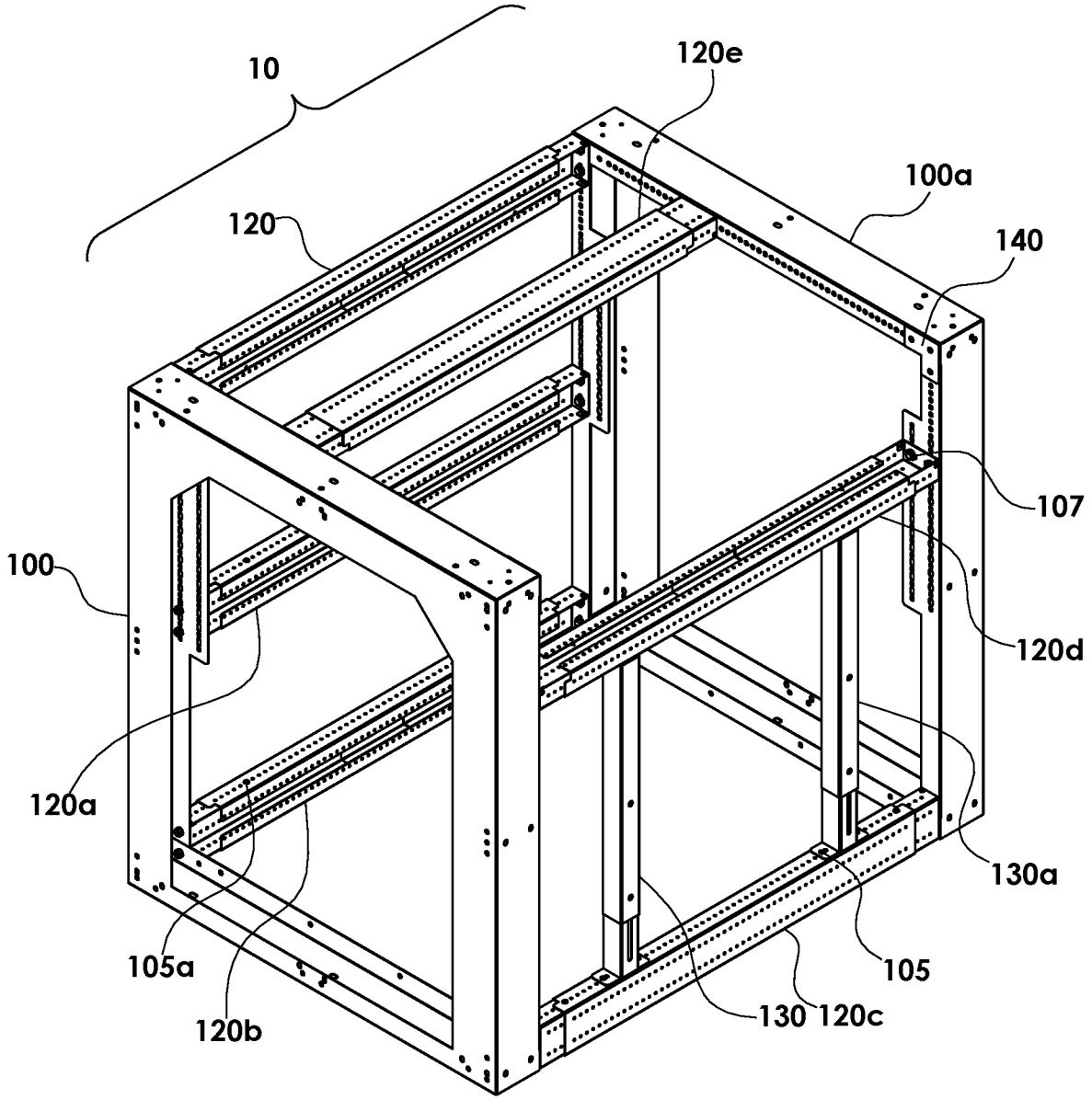
FIG. 1 shows a front perspective view of an exemplary module of the present invention, as assembled, this one suitable for supporting a grill in an outdoor kitchen.
Figure 2:
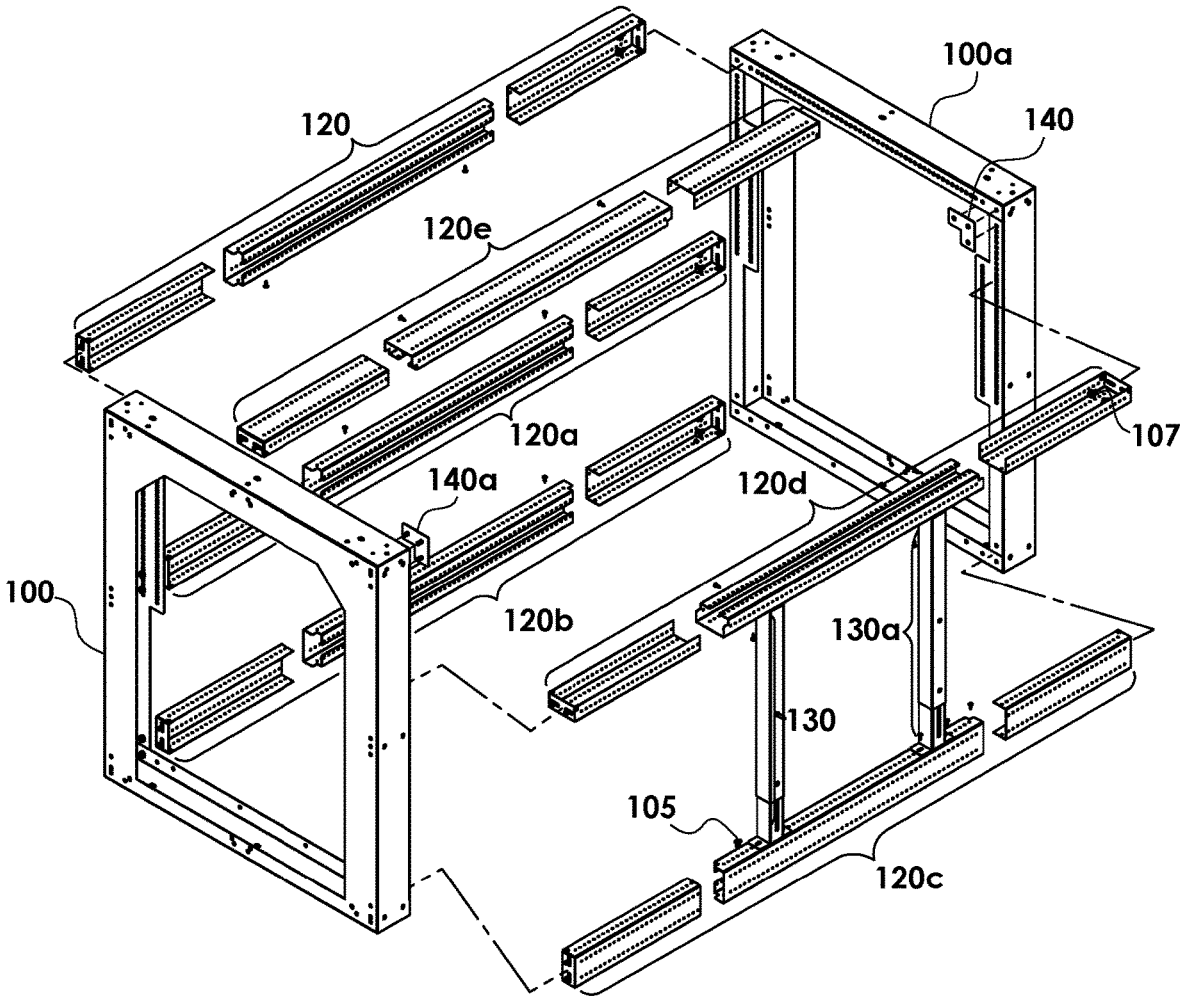
FIG. 2 shows a front perspective exploded assembly view of an exemplary module of the present invention, showing the several standardized components comprising the exemplary module.
Figure 3:
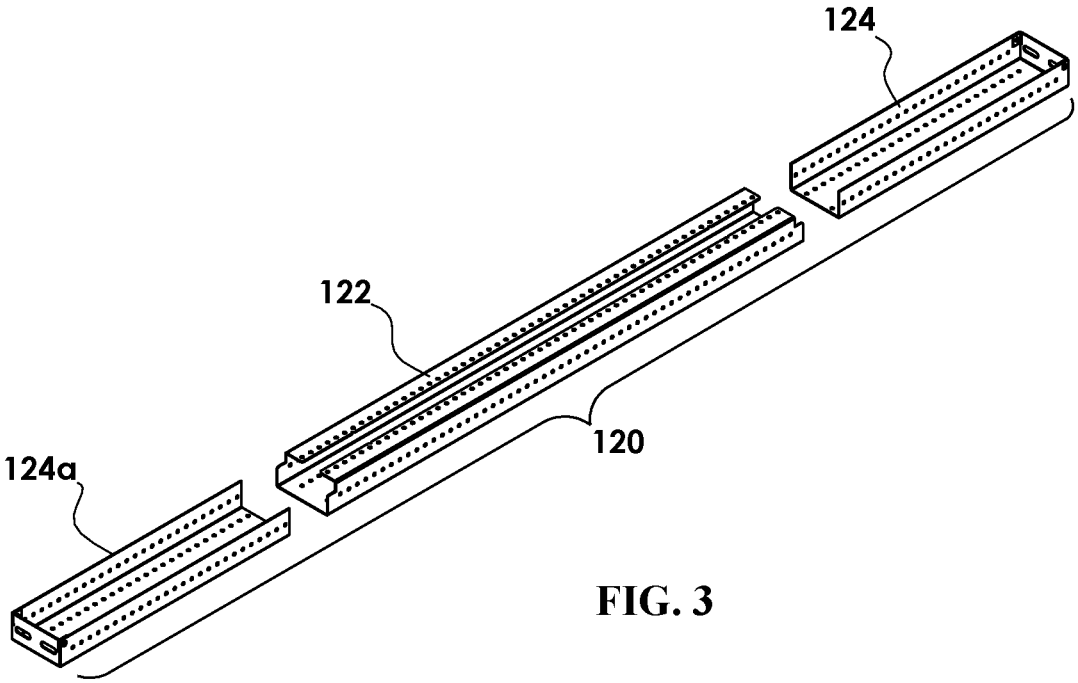
FIG. 3 shows a perspective exploded assembly view of an adjustable horizontal channel, one of the standardized components of the inventive modules.

With reference to FIGS. 1 and 2, the inventive apparatus may include a grill module 10 which may be adjusted at time of assembly to fit a range of grills, of varying width, height, and depth. The grill module 10 comprises, it has been found advantageous, a small number of distinct components which may be used in various combinations and positions to create the grill module 10, or which components may be assembled and/or configured to make other modules of custom cabinetry framing, or used as framing for non-cabinetry purposes. With a limited number of components, the components of the grill module 10 and of other modules as described herein may be packed, stocked, and shipped in a flat container, and then assembled on-site by a homeowner, contractor, or one skilled in the trades, thus simplifying manufacturing, shipping, stocking, and assembly. The grill module 10 comprises a plurality of end frames 100-100*a*, a plurality of adjustable horizontal channels 120-120*e*, a plurality of adjustable narrow channels 130-130*a*, and a plurality of corner braces 140-140*a*, collectively referred to as components in the present disclosure, as well as fasteners to hold these components together. It has been found advantageous to have these and other components, as later described herein, made of a galvanized steel sheet material, for ease of manufacturing and strength of the finished grill module 10, though other materials now known or later invented may be used. Advantageously, such material will be sheet materials (being the singular, that is, only one type of material, or the plural, that is, more than one type of material) that may be cut, punched, and/or folded, though it will be understood by one of skill in the art that non-sheet materials may be used.

To form a grill module 10, each of the plurality of adjustable horizontal channels 120-120*e*, comprising two distal ends (being end slide distal faces 210), is attached at one of its distal ends to one of the plurality of end frames 100-100*a*, and each of the plurality of adjustable horizontal channels 120-120*e* is attached at its opposite distal end to the other one of the plurality of end frames 100-100*a*, as depicted in FIGS. 1 and 2. The plurality of adjustable horizontal channels 120-120*e* are connected by the user (or person assembling the components and module) to each of the plurality of end frames 100-100*a*, using a plurality of bolted connector assemblies 107. Each of the plurality of bolted connector assemblies 107 is connected through one of the plurality of distal-face slots 180 of a horizontal end slide 124 of one of the plurality of adjustable horizontal channels 120-120*e*, through one of the end frame mounting holes (as appropriate, any of the individual holes of the pluralities of end frame mounting holes may be used, to achieve the desired positioning of the desired one of the plurality of adjustable horizontal channels 120-120*e*) of one of the plurality of end frames 100-100*a*, so that each of the plurality of bolted connector assemblies 107 connects one of the plurality of adjustable horizontal channels 120-120*e* to one of the plurality of end frames 100-100*a*, as depicted in FIGS. 1 and 2.

While only one of the plurality of bolted connector assemblies 107 is shown in FIGS. 1-2, it will be understood by one of skill in the art that a plurality of bolted connector assemblies 107 may be used to connect each end of each of the plurality of adjustable horizontal channels 120-120*e* to each of the plurality of end frames 100-100*a*. It will further be understood that each of the plurality of adjustable horizontal channels 120-120*e* may be positioned with its shortest dimension either horizontal (as is shown by the first adjustable horizontal channel 120) or vertical (as is shown by the sixth adjustable horizontal channel 120*e*), and each may be positioned with an end slide dorsal face 214 and a plurality of end slide dorsal face holes 184 (with reference to FIG. 11, and as described in greater detail elsewhere in the present disclosure) oriented in any of the four ordinal relative directions (up such as the sixth adjustable horizontal channel 120*e*, down such as the fifth adjustable horizontal channel 120*d*, frontward such as the fourth adjustable horizontal channel 120*c*, or backward such as the third adjustable horizontal channel 120*b*) as is appropriate for attaching of cabinetry facing or cladding, or connecting of other components of the present invention.

A plurality of threaded connectors 105-105*x* may be used (where 105*x* does not necessarily refer to a particular twenty-fifth threaded connector 105, but rather to any of x number of threaded connectors 105) to connect any of several component or parts of components to each other. While only a small number of the plurality of threaded connectors 105-105*x* are depicted, it will be understood by one of skill in the art that many more can and would be used in the assembly of the modules of the present invention. With reference to FIGS. 1, 2, and 15-20, a threaded connector 105 may be used to connect a first adjustable narrow channel 130 and a second adjustable narrow channel 130*a* to one or more of the plurality of adjustable horizontal channels 120-120*e*, specifically as shown in FIGS. 1 and 2, to the fourth adjustable horizontal channel 120*c* and the fifth adjustable horizontal channel 120*d*, to support the fifth adjustable horizontal channel 120*d* as it supports the grill to be installed in the grill module 10. Each of the plurality of threaded connectors 105-105*x* is passed through either one of a plurality of narrow channel slide mounting slots 254 or one of a plurality of narrow channel sleeve mounting slots 258, and then into a mounting hole in one of the plurality of adjustable horizontal channels 120-120*e* (for a grill module 10 as shown in FIGS. 1-2, into either the fourth adjustable horizontal channel 120*c* or the fifth adjustable horizontal channel 120*d*, as appropriate) to contribute to forming the structure of the grill module 10. One or more of the plurality of threaded connectors 105-105*x* may be used to fix the length of each of the plurality of adjustable horizontal channels 120-120*e*, with reference to FIGS. 1 and 12-14, by securing each horizontal channel sleeve 122 to each first horizontal end slide 124 and to each second horizontal end slide 124*a*, thus forming and fixing the length of each of the plurality of adjustable horizontal channels 120-120*e*.

COMPONENT: end frames 100-100*a*

In the grill module 10 pictured in FIGS. 1 and 2, the grill module 10 comprises a first end frame 100, a second end frame 100*a*, a first adjustable horizontal channel 120, a second adjustable horizontal channel 120*a*, a third adjustable horizontal channel 120*b*, a fourth adjustable horizontal channel 120*c*, a fifth adjustable horizontal channel 120*d*, a sixth adjustable horizontal channel 120*e*, a first adjustable narrow channel 130, and a second adjustable narrow channel 130*a*. Each of the plurality of end frames 100-100*a* is identical, so that either the first end frame 100 or the second end frame 100*a* may be used on the left or right side of the grill module 10. With reference to FIGS. 5, 6, 7, 8, 24A, and 24B, each of the plurality of end frames 100-100*a* comprises a first lateral side 165, a second lateral side 169, a bottom side 171, an inside face 167, a top side 168, and an outside face 173. The aforementioned sides of each of the plurality of end frames 100-100*a* are roughly or exactly parallel or perpendicular to each other (with the inside face 167 and outside face 173 parallel to each other, the first lateral side 165 and second lateral side 169 parallel to each other, and the top side 168 and bottom side 171 parallel to each other, and each such pair of parallel sides perpendicular to the other sides), such that each of the plurality of end frames 100-100*a* comprises the shape of a hollow rectangular solid, with openings in some of the sides. To be used to make a grill module 10, each of the plurality of end frames 100-100*a* should be oriented with the top side 168 up and the inside face 167 facing the other of the plurality of end frames 100-100*a*, as is depicted in FIGS. 1-2. When each of the plurality of plurality of end frames 100-100*a* is being made, with reference to FIGS. 24A and 24B, each of the plurality of end frames 100-100*a* may be made from a single sheet of material that is cut and punched with one or more pluralities of holes or slots, making multiple folds of the single sheet of material, with some such sheet material folding lines 350 illustrated by way of example in FIG. 24A. It will be understood by one of skill in the art that many other such sheet material folding lines are used in the folding of each piece of sheet material used in manufacturing each component of the present invention, but for the sake of simplicity and legibility of the present patent illustrations, not all such sheet material folding lines 350 are illustrated.

Each of the plurality of end frames 100-100*a* further comprises a plurality of counter support brace mounting holes 150, a first plurality of back splash unit mounting holes 151, a second plurality of back splash unit mounting holes 152, a plurality of countertop mounting holes 153, a first plurality of bar top support brace mounting holes 154, a first plurality of horizontal channel mounting holes 155, a second plurality of horizontal channel mounting holes 156, a second plurality of bar top support brace mounting holes 157, a third plurality of bar top support brace mounting holes 158, a third plurality of horizontal channel mounting holes 159, a fourth plurality of horizontal channel mounting holes 160, a fifth plurality of horizontal channel mounting holes and slots 161, and a plurality of end frame attachment holes 163; all of which pluralities of mounting holes are collectively referred to herein for simplicity as the end frame mounting holes, without conflating their separate nature or uses. The aforementioned pluralities of end frame mounting holes in each end frame 100 allow the end frames to be attached to the other components of the grill module 10, and to have the rough and/or finish exterior (also referred to as facing, cladding, finishing, or finishes) of the desired cabinetry attached to the grill module 10 cabinetry framework, including but not limited to cladding, a countertop, a backsplash, the grill or other cooking surface, or a sink, either for a grill module 10 or in other embodiments of the presently described apparatus. As discussed above, any finishes, hardware, or other items discussed herein may be attached and mounted on the cabinetry framework of the present invention because the presently disclosed modules are adjustable for width and height of their openings.

In some embodiments of the present invention, to make certain modules, an adjustable horizontal channel 120 may be used to span and connect each of the plurality of end frames 100-100*a* to each other. For instance, without limiting the disclosure contained herein, four adjustable horizontal channels 120-120*c* may connect each of the four corners of the inside faces 167 of the end frames 100-100*a*. But, with reference to FIGS. 1 and 2, when the components of the present invention are used to make a grill module 10, the top front corners of the plurality of end frames 100-100*a* cannot be obstructed by an adjustable horizontal channel 120, as the grill chosen by the user must occupy that space. Accordingly, a first corner brace 140 and a second corner brace 140*a* may be used to brace the inside faces 167 of the plurality of end frames 100-100*a*, as shown in FIGS. 1 and 2. The first corner brace 140 and the second corner brace 140*a* may be made, as will be understood by one of skill in the art, of the same sheet material as the other components disclosed here, though other materials may be suited and used. The first corner brace 140 and the second corner brace 140*a*, with reference to FIGS. 1, 2, and 21-23, are cut from sheet material and advantageously not folded, and are of a size and shape that matches the folded inside face 167 of an end frame 100. Each corner brace 140 has a corner brace proximal face 142 which is placed in contact with the inside face 167 of the end frame 100, and then the corner brace 140 is secured to the end frame 100 with a plurality of corner brace connectors 144, which may comprise a first corner brace connector 144*a*, a second corner brace connector 144*b*, and a third corner brace connector 144*c*. With the plurality of corner brace connectors 144, each of the corner braces 140-140*a* brace and reinforce each of the plurality of end frames 100-100*a*, providing reinforcement and strength, and allowing any of a range of grills to be placed in the inventive grill module 10.

COMPONENT: adjustable horizontal channels 120-120*e*.

Each of the plurality of adjustable horizontal channels 120-120*e* are symmetrical left-right, so that there is no left or right side that must be attached to a particular one of the plurality of end frames 100-100*a*. With reference to FIGS. 3, 9, 10, 11, 12, 13, 14, and 14A, each of the plurality of adjustable horizontal channels 120-120*e* comprises a horizontal channel sleeve 122, a first horizontal end slide 124, and a second horizontal end slide 124*a*. Each of the first horizontal end slide 124 and the second horizontal end slide 124*a* are identical, and may be used on either end of the horizontal channel sleeve 122. Each of the first horizontal end slide 124 and the second horizontal end slide 124*a* comprise an end slide distal face 210, an end slide lateral face 212, an end slide dorsal face 214, a plurality of distal-face slots 180, a plurality of end slide lateral face holes 182, a plurality of end slide dorsal face holes 184, and a first end slide bent tab 188 and a second end slide bent tab 188*a*. Each horizontal channel sleeve 122 comprises a plurality of half-round notches 200, a plurality of channel sleeve lateral face holes 202, a plurality of channel sleeve dorsal face holes 204, a plurality of channel sleeve ventral face holes 206, a channel sleeve lateral face 220, a channel sleeve dorsal face 222, a channel sleeve ventral face 224, a channel sleeve distal end surface 226, and a channel sleeve distal end notch 208. Each of the aforementioned sides are roughly or exactly perpendicular to each other, or parallel to each other, such that each of the plurality of end slides 124-124*a* and the horizontal channel sleeve 122 are shaped like hollow rectangular solids, with openings and holes.

Figure 25A:
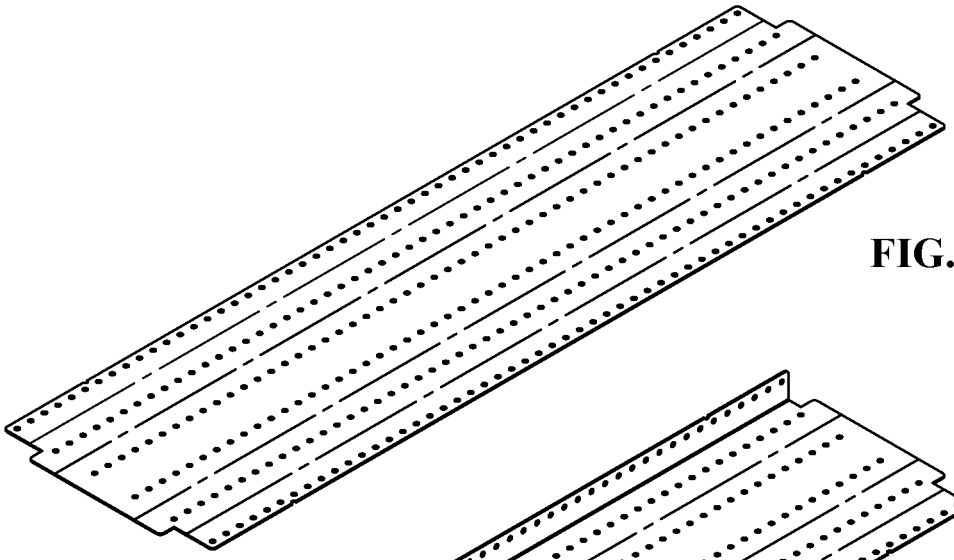
FIG. 25A shows a perspective view of the sheet material for a horizontal channel sleeve, as flat, before being folded.
Figure 25B:
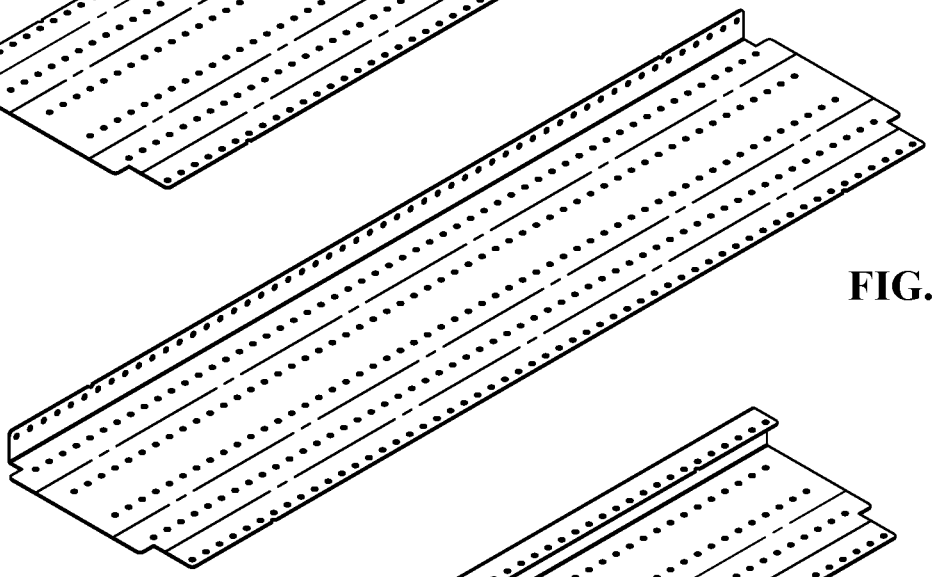
FIG. 25B shows a perspective view of the sheet material for a horizontal channel sleeve, with one completed bend to form what will be one of the sleeve faces of a horizontal channel sleeve.
Figure 25C:
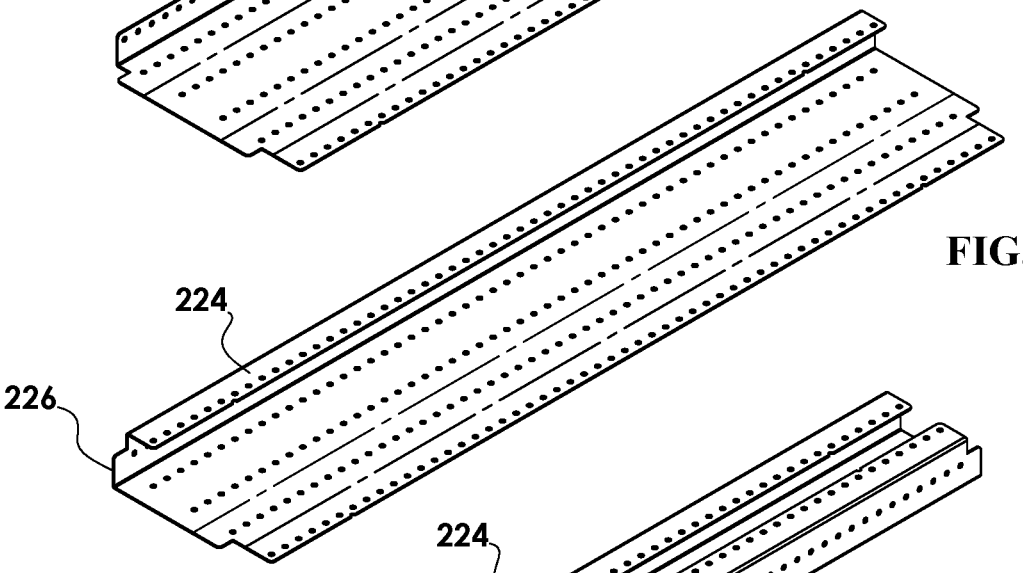
FIG. 25C shows a perspective view of the sheet material for a horizontal channel sleeve, with two completed bends to form one of the sides and one of the sleeve faces of a horizontal channel sleeve.
Figure 25D:
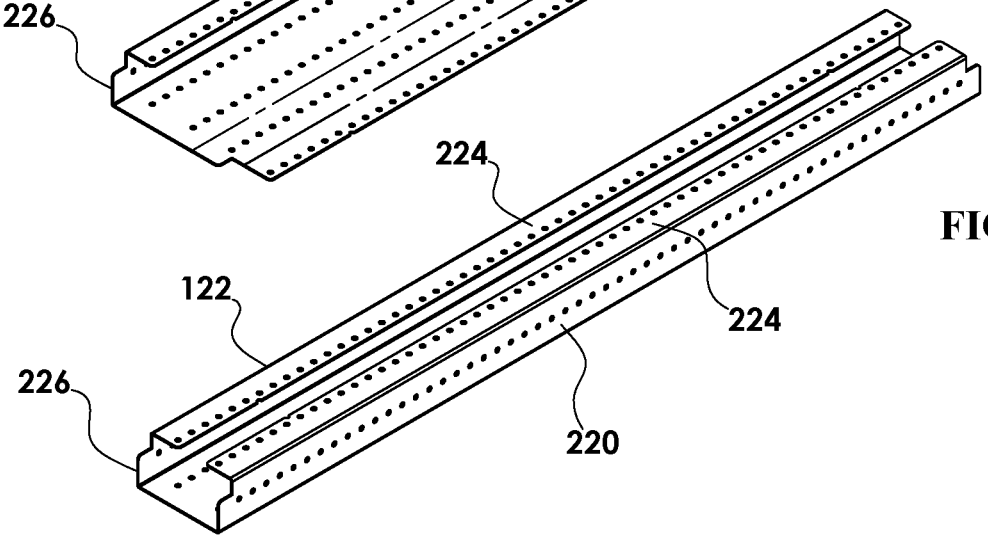
FIG. 25D shows a perspective view of the sheet material for a horizontal channel sleeve, with four completed bends, forming a horizontal channel sleeve with two sides and two sleeve faces.

With reference to FIGS. 25A, 25B, 25C, and 25D, a horizontal channel sleeve 122 may be made from a single sheet of material that is cut and punched with one or more pluralities of holes, as shown in FIG. 25A. By making multiple folds of the single sheet of material, the channel sleeve ventral face 224 and the channel sleeve distal end surface 226 are formed, as depicted in FIGS. 25B and 25C. Here, by making four folds parallel to the long axis of the sheet of material, and symmetrically spaced away from that long axis of the sheet of material, the horizontal channel sleeve 122 is formed, as shown in FIG. 25D, showing the channel sleeve lateral face 220, the channel sleeve ventral face 224, and the channel sleeve distal end surface 226.

When a first horizontal end slide 124 is made by folding a sheet of material, as shown fully folded in FIG. 3 and FIGS. 9-11, the first end slide bent tab 188 and the second end slide bent tab 188*a* are folded from the piece of the sheet of material that comprises the end slide distal face 210 until the first end slide bent tab 188 and the second end slide bent tab 188*a*, each still attached to the end slide distal face 210, are parallel to the end slide lateral face 212 and to the opposite and parallel end slide lateral face 212*a*, with the first end slide bent tab 188 and the second end slide bent tab 188*a* sitting snugly inside of the end slide lateral face 212 and the end slide lateral face 212*a*. The first end slide bent tab 188 is attached to the end slide lateral face 212 with a first pop-rivet 186, through a hole in the end slide lateral face 212. Likewise, the second end slide bent tab 188*a* is attached to the end slide lateral face 212*a* with a second pop-rivet 186*a*, through a hole in the end slide lateral face 212*a*. It will be understood by one of skill in the art that other connectors may be used, though pop rivets have been found advantageous in attaching the end slide distal face 210 to the end slide lateral face 212 and to the end slide lateral face 212*a*.

With reference to FIGS. 3, 9, 10, 11, 12, 13, 14, and 14A, each of the first horizontal end slide 124 and the second horizontal end slide 124*a*, and the horizontal channel sleeve 122 are made such that their cross-sectional dimensions, as shown by their respective end slide distal faces 210 and channel sleeve distal end surfaces 226, overlap snugly such that a first horizontal end slide 124 and a second horizontal end slide 124*a* may slide securely over a horizontal channel sleeve 122, situated so that the end slide distal face 210 of the first horizontal end slide 124 is distal to the horizontal channel sleeve 122 and to the end slide distal face 210 of the second horizontal end slide 124*a*. In this way, the width of an adjustable horizontal channel 120 may be adjusted to adjust the width of a grill module 10 to accommodate grills of different sizes, or other items the inventive module is intended to hold in other configurations of the present invention. When the grill module 10 or other module is being assembled, and a plurality of adjustable horizontal channels 120 are being adjusted to a particular width, each of the plurality of half-round notches 200, as shown in FIGS. 14 and 14A, indicates the maximum width of that adjustable horizontal channel 120, by indicating the minimum amount of overlap required for sufficient strength and support between the horizontal channel sleeve 122 and the first horizontal end slide 124 at one end of the horizontal channel sleeve 122, and between the horizontal channel sleeve 122 and the second horizontal end slide 124*a* at the opposite end of the horizontal channel sleeve 122. Each horizontal channel sleeve 122 has a plurality of half-round notches 200, and it has been found advantageous to have at least four such half-round notches 200 in each horizontal channel sleeve.

Note that not all exemplary modules of the present invention may be adjustable as to width, as the grill module 10 is and as a refrigerator module 300 is, for instance. Modules that are not adjustable as to width, such as a fixed-width module 400 or a power burner module 500, will be packaged and shipped with a plurality of fixed-width horizontal channels 410, to set the width of the relevant module to the desired overall width without adjustment. Please see below for further discussion of such modules and their relevant components.

COMPONENT: adjustable narrow channels 130-130*a*

Figure 4:
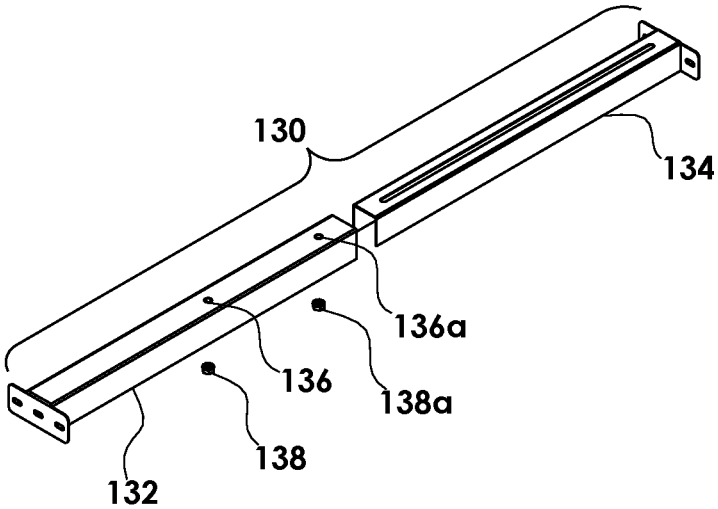
FIG. 4 shows a perspective exploded assembly view of an adjustable narrow channel, one of the standardized components of the inventive modules.
Figure 5:
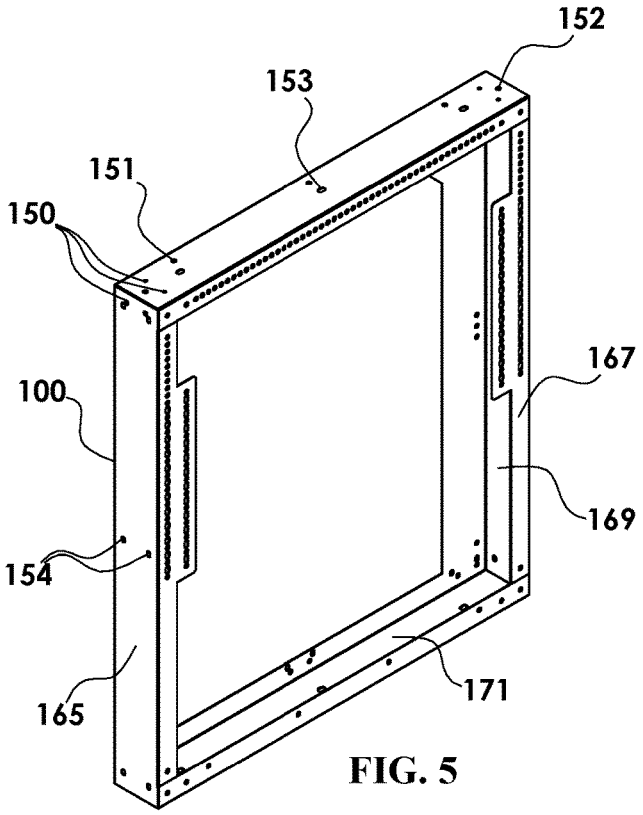
FIG. 5 shows a perspective view of the inside face of an end frame, as assembled, one of the standardized components of the inventive modules.
Figure 6:
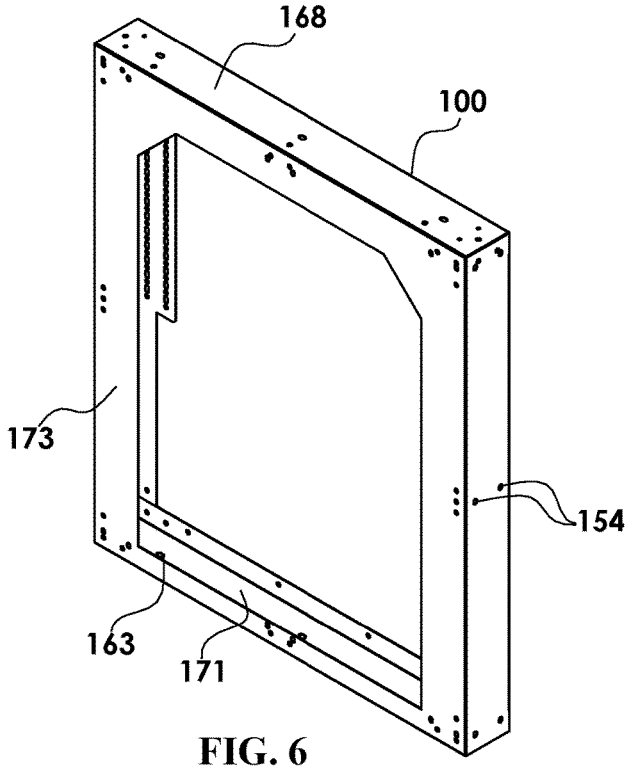
FIG. 6 shows a perspective view of the outside face of an end frame, as assembled, one of the standardized components of the inventive modules.
Figure 7:
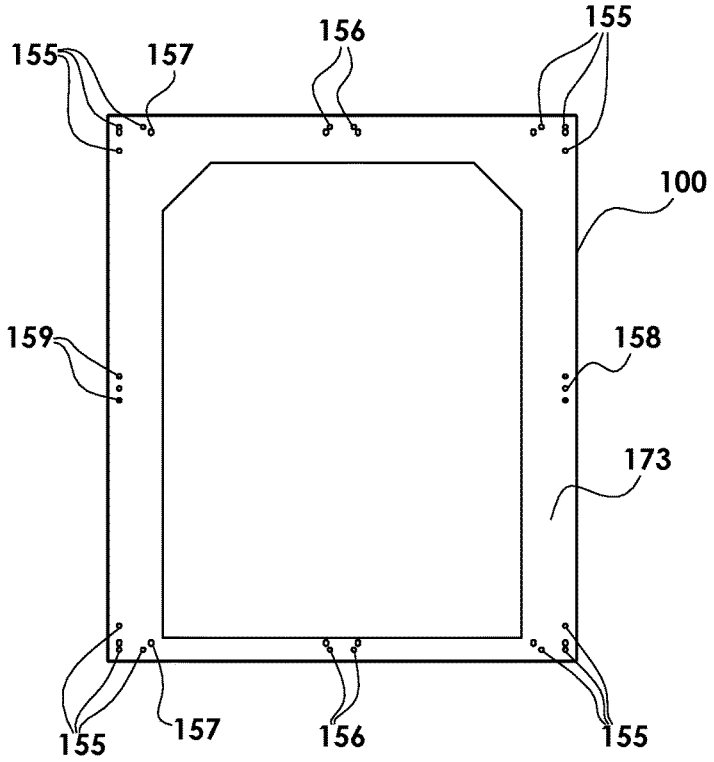
FIG. 7 shows an elevation view of the outside face of an end frame, as assembled, one of the standardized components of the inventive modules.
Figure 8:
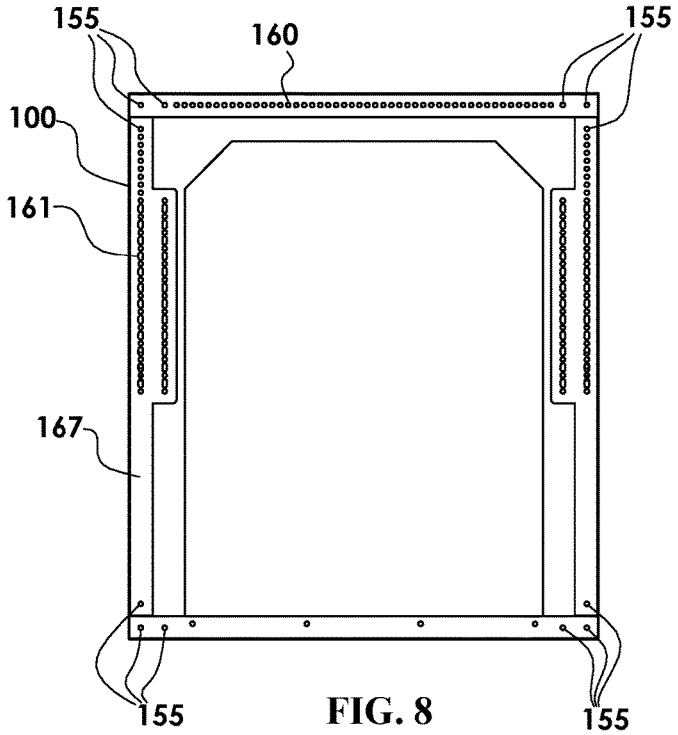
FIG. 8 shows an elevation view of the inside face of an end frame, as assembled, one of the standardized components of the inventive modules.
Figure 17:
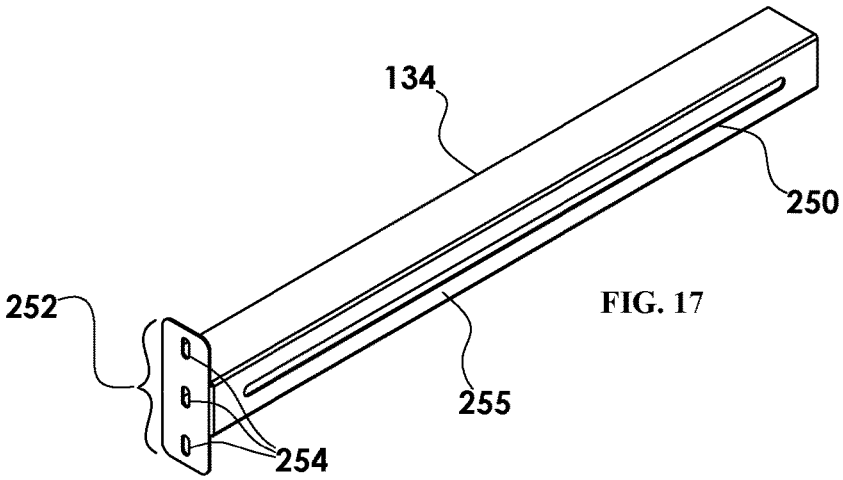
FIG. 17 shows a perspective view of a narrow channel slide, one of the parts of an adjustable narrow channel.
Figure 20:
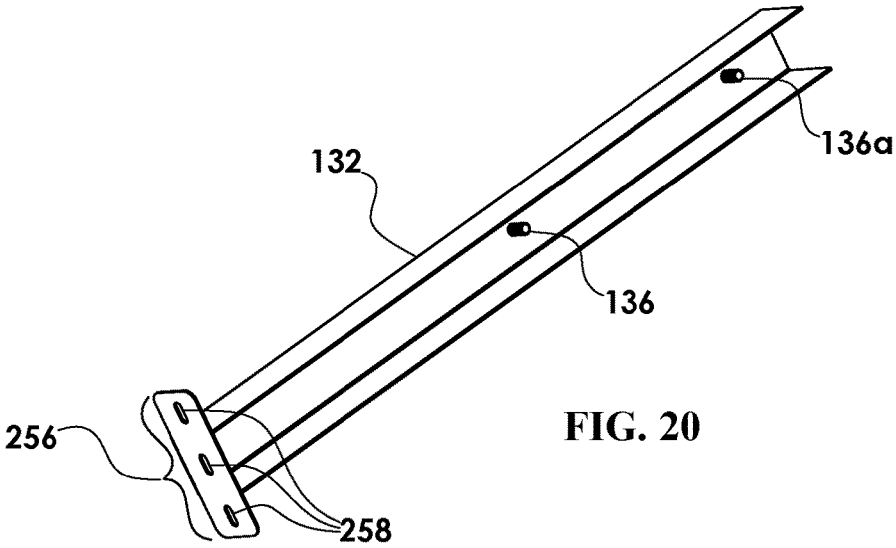
FIG. 20 shows a perspective view of a narrow channel sleeve, one of the parts of an adjustable narrow channel.

With reference to FIGS. 4 and 15-20, the first adjustable narrow channel 130 and the second adjustable narrow channel 130*a* are identically made; each comprise a narrow channel sleeve 132 and a narrow channel slide 134. Each of the narrow channel sleeve 132 and the narrow channel slide 134 may be made from a single sheet of material that is cut and punched with one or more pluralities of holes or slots, and each of the narrow channel sleeve 132 and the narrow channel slide 134 are folded to form hollow rectangular solids. The narrow channel sleeve 132 and the narrow channel slide 134 may, it has been found advantageous, be cut and folded to have only three sides parallel to their long axes: the axes on which they are engaged and can be adjusted to a chosen length, and then secured at that length. This three-sided arrangement for each of the narrow channel sleeve 132 and the narrow channel slide 134, and as shown in FIGS. 4, 17, and 20, provides for sufficient strength to bear the required loads, a sufficient and flush mounting surface for the user's desired cabinet facing or doors, and easy access to the connectors and fasteners used to secure the narrow channel sleeve 132 and the narrow channel slide 134 to each other at the user's chosen and appropriate length, as is described below.

The narrow channel sleeve 132 and the narrow channel slide 134 are folded with cross-sectional dimensions such that the narrow channel sleeve 132 may slide freely but snugly over the narrow channel slide 134. By adjusting the amount of overlap of the narrow channel sleeve 132 and the narrow channel slide 134, the length of the first adjustable narrow channel 130 and of the second adjustable narrow channel 130*a* may be set to accommodate grills of various heights, when assembling a grill module 10. When the user or installer assembles any of the plurality of adjustable narrow channel 130, the user may choose an appropriate length of each adjustable narrow channel 130. That length may then be secured, by fastening the narrow channel sleeve 132 and the narrow channel slide 134 together, utilizing a first narrow channel connector 136, a second narrow channel connector 136*a*, a first narrow channel fastener 138, a second narrow channel fastener 138*a*, and a narrow channel slide slot 250. The chosen length of each adjustable narrow channel 130 should correspond to the desired height of the hardware and/or accessories that are to be attached to and/or installed in the face of the module, which accessories may be doors, drawers, or shelf structures, or other desired accessories. The placement of each adjustable narrow channel 130 side-to-side in the module will determine the width of the opening available for any such accessories, and should be selected by the user or person assembling the module to properly and securely accommodate the desired accessories. Any module that is assembled with a plurality of adjustable narrow channels 130 may have the length of each adjustable narrow channel 130 and the spacing between each adjustable narrow channel 130 set to accommodate the desired accessories.

Figure 19:
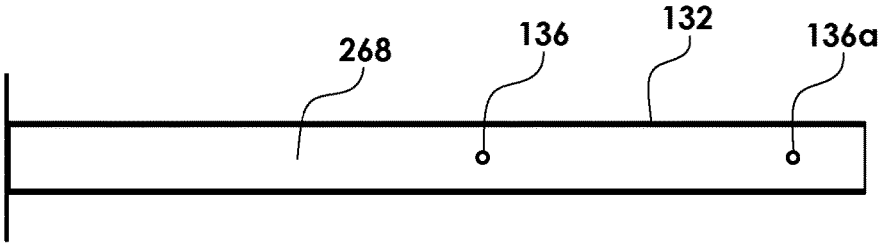
FIG. 19 shows a side elevation view of a narrow channel sleeve, one of the parts of an adjustable narrow channel.
Figure 23:
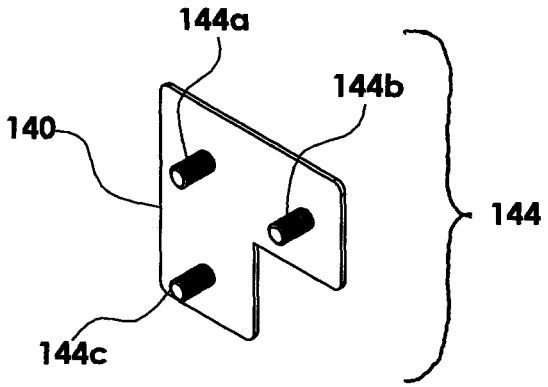
FIG. 23 shows a perspective view of a corner brace, with fasteners.
Figure 21:
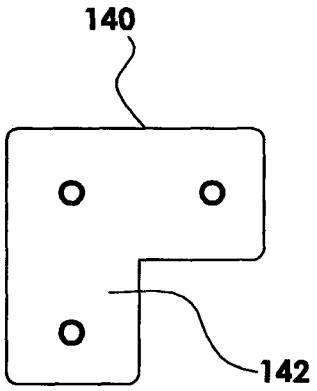
FIG. 21 shows a front elevation view of a corner brace.
Figure 22:
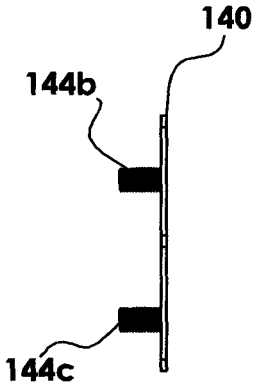
FIG. 22 shows a side elevation view of a corner brace, with fasteners.
Figure 24A:
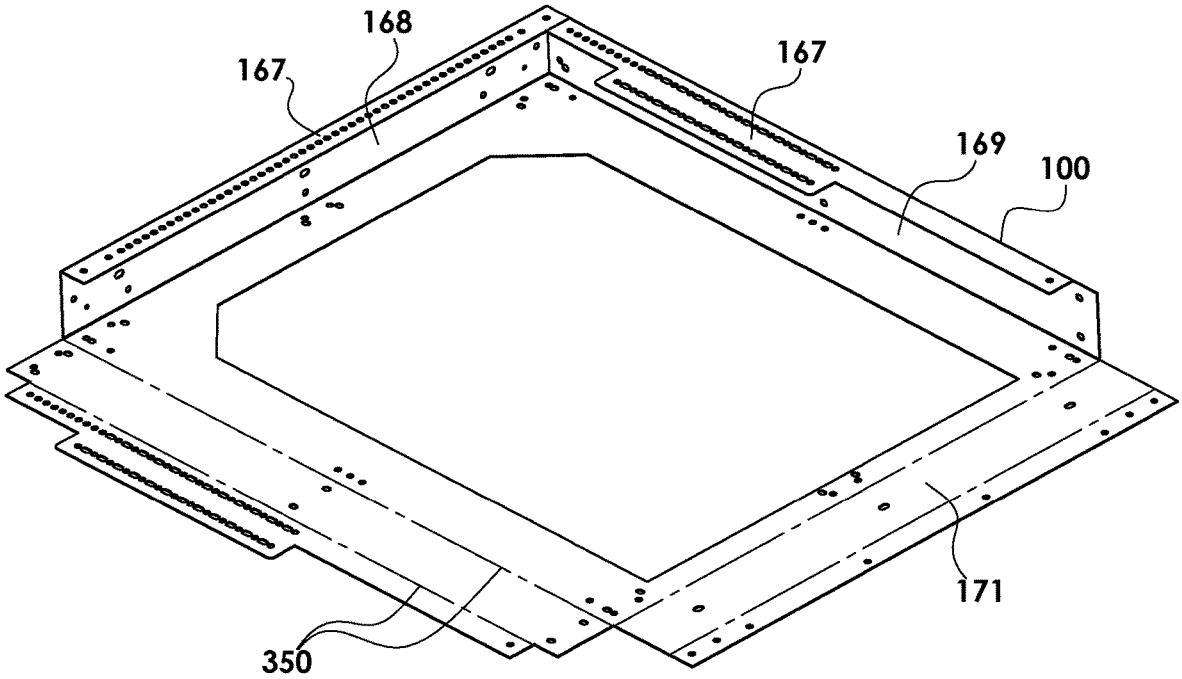
FIG. 24A shows a perspective view of an end frame, looking at the inside face from the direction of the bottom of the end frame, with the sheet material comprising the end frame partially bent to complete the top side and one lateral side of the end frame, and the two corresponding sections of the inside face of the end frame.
Figure 24B:
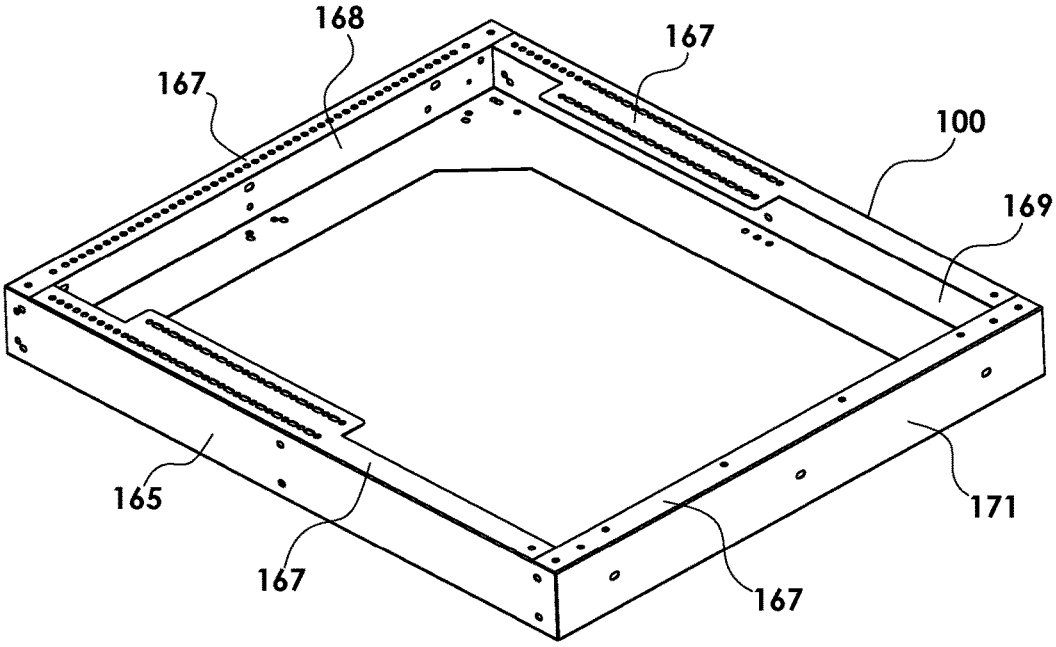
FIG. 24B shows a perspective view of an end frame, looking at the inside face from the direction of the bottom of the end frame, with the sheet material comprising the end frame fully bent to complete the top side, bottom side, both lateral sides of the end frame, and all four corresponding sections of the inside face of the end frame.

The first narrow channel connector 136 and the second narrow channel connector 136*a* are set through holes in a narrow channel sleeve lateral face 268 of the narrow channel sleeve 132, as shown in FIGS. 4, 19, and 20, and set through the narrow channel slide slot 250 in the narrow channel slide lateral face 255 of the narrow channel slide 134. The narrow channel sleeve lateral face 268 and the narrow channel slide lateral face 255 are the middle faces of their respective components, that is, they are opposite the open faces (where there is no material) of the narrow channel sleeve 132 and the narrow channel slide 134, respectively.

The overall assembly of the adjustable narrow channel 130 is then set at a chosen length, and the first narrow channel connector 136 and the second narrow channel connector 136*a* are then secured with the first narrow channel fastener 138 and the second narrow channel fastener 138*a*, securing the narrow channel sleeve 132 and the narrow channel slide 134 to each other, and fixing that adjustable narrow channel 130 at the chosen length. It has been found advantageous to have the first narrow channel connector 136 and the second narrow channel connector 136*a* be press-fit threaded studs and to have the first narrow channel fastener 138 and the second narrow channel fastener 138*a* be lock nuts suited to engage with the first narrow channel connector 136 and the second narrow channel connector 136*a* securing the narrow channel sleeve 132 and the narrow channel slide 134 to each other, but it will be understood by one of skill in the art that other types of connectors and fasteners suitable for fixedly connecting with each other to secure the narrow channel sleeve 132 and the narrow channel slide 134 to each other, whether those connectors and fasteners are now known or later invented, may also be used.

Figure 15:
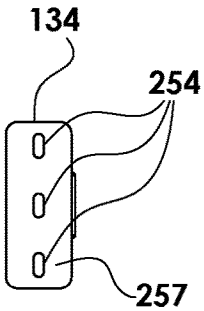
FIG. 15 shows a front elevation view of the distal end (with mounting tabs) of a narrow channel slide, one of the parts of an adjustable narrow channel.
Figure 16:
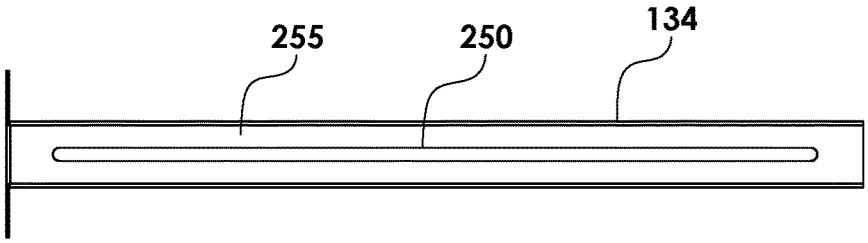
FIG. 16 shows a side elevation view of a narrow channel slide, one of the parts of an adjustable narrow channel.

With reference to FIGS. 15, 16, and 17, the narrow channel slide 134 further comprises a narrow channel slide mounting foot 252, which is advantageously formed by cutting and/or bending part of the sheet of material of which the narrow channel slide 134 is comprised such that the narrow channel slide mounting foot 252 is perpendicular to the narrow channel slide lateral face 255. The narrow channel slide mounting foot 252 itself comprises a narrow channel slide distal mounting face 257, which is the face of the narrow channel slide mounting foot 252 away from the narrow channel slide lateral face 255 and the entirety of the rest of the narrow channel slide 134. The face of the narrow channel slide mounting foot 252 opposite the narrow channel slide distal mounting face 257 should advantageously make contact with the edges of the narrow channel slide lateral face 255 and of the other faces of the narrow channel slide 134 which are parallel to the long axes of the narrow channel slide lateral face 255 and of the other faces of the narrow channel slide 134, so that the narrow channel slide mounting foot 252 can support the load borne by the narrow channel slide 134 and the adjustable narrow channel 130, as each adjustable narrow channel 130 functions to support the affixing or hardware of the various desired accessories to be installed in the given module, including but not limited to doors, drawers, or shelf structures, as described in the present disclosure. The narrow channel slide mounting foot 252 further comprises a plurality of narrow channel slide mounting slots 254, which are cut or punched through the narrow channel slide mounting foot 252. The plurality of narrow channel slide mounting slots 254 allow each of the adjustable narrow channels 130 to be attached securely to other components of the modules of the present invention, as described in this present disclosure, to form a variety of modules of the present invention.

Figure 18:
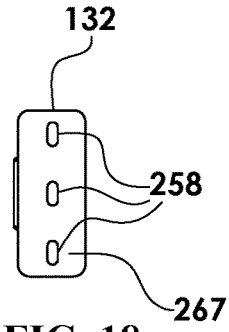
FIG. 18 shows a front elevation view of the distal end (with mounting tabs) of a narrow channel sleeve, one of the parts of an adjustable narrow channel.

With reference to FIGS. 18, 19, and 20, the narrow channel sleeve 132 further comprises a narrow channel sleeve mounting foot 256, which is advantageously formed by cutting and/or bending part of the sheet of material of which the narrow channel sleeve 132 is comprised such that the narrow channel sleeve mounting foot 256 is perpendicular to the narrow channel sleeve lateral face 268. The narrow channel sleeve mounting foot 256 itself comprises a narrow channel sleeve distal mounting face 267, which is the face of the narrow channel sleeve mounting foot 256 away from the narrow channel sleeve lateral face 268 and the entirety of the rest of the narrow channel sleeve 132. The face of the narrow channel sleeve mounting foot 256 opposite the narrow channel sleeve distal mounting face 267 should advantageously make contact with the edges of the narrow channel sleeve lateral face 268 and of the other faces of the narrow channel sleeve 132 which are parallel to the long axes of the narrow channel sleeve lateral face 268 and of the other faces of the narrow channel sleeve 132, so that the narrow channel sleeve mounting foot 256 can support the load borne by the narrow channel sleeve 132 and the adjustable narrow channel 130. The narrow channel sleeve mounting foot 256 further comprises a plurality of narrow channel sleeve mounting slots 258, which are cut or punched through the narrow channel sleeve mounting foot 256. The plurality of narrow channel sleeve mounting slots 258 allow each of the adjustable narrow channels 130 to be attached securely to other components of the modules of the present invention, as described in this present disclosure, to form a variety of modules of the present invention.

MODULE: refrigerator module 300.

Figure 26:
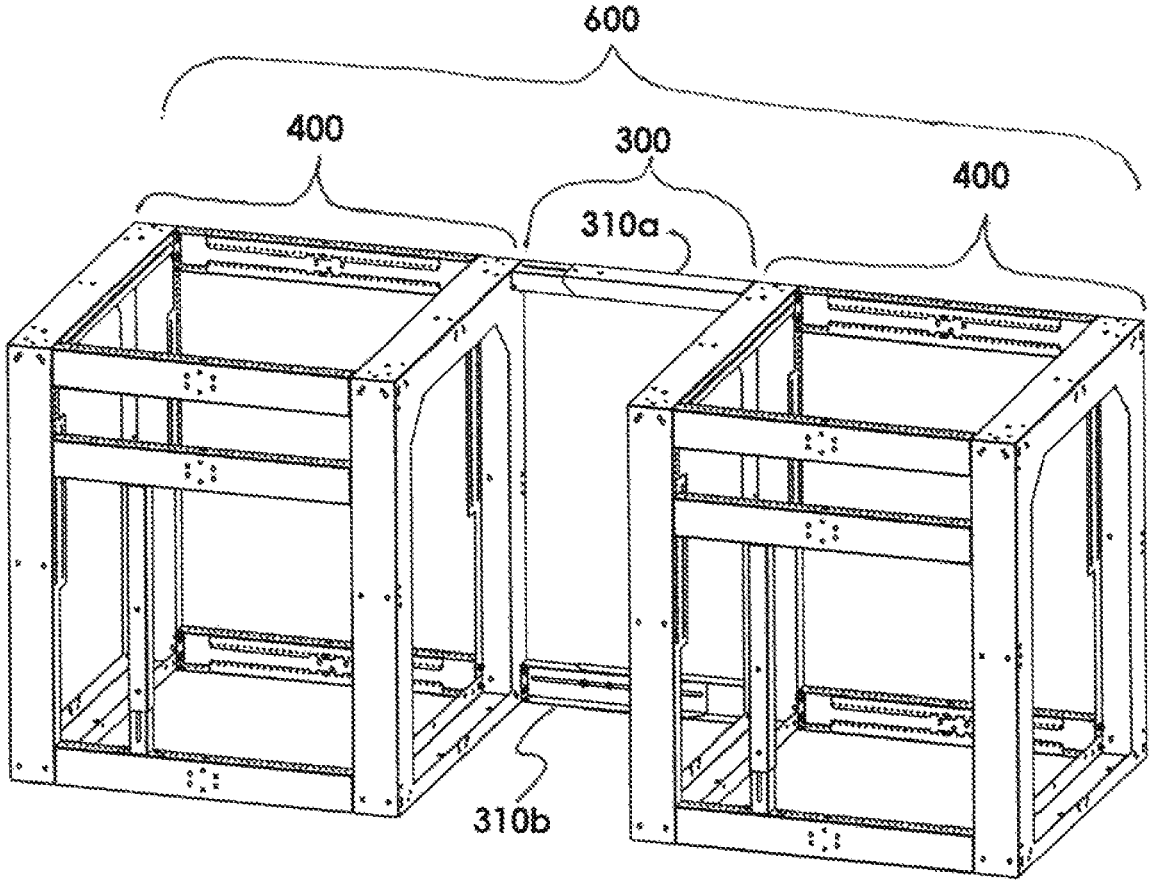
FIG. 26 shows a front perspective view of a plurality of assembled modules, here, two fixed-width modules and one refrigerator module.

With references to FIGS. 26 through 35, the inventive apparatus may include a refrigerator module 300. A refrigerator module 300 may comprise as few as two assembled components, or may comprise a plurality of components in a number other than two. FIG. 26 shows a front perspective view of a refrigerator module 300 assembled between two other modules (for illustrative purposes here, both are fixed-width modules 400, but they could be other modules of the present invention), with the assembly and connection of any more than one exemplary module of modular flat-pack customizable cabinetry framing being referred to as a multi-module assembly 600 (illustrated herein without limitation as to other combinations of exemplary modules), and in which multi-module assembly 600 any of the more than one modules may be assembled and connected to one or more of the other modules, which may be achieved by affixing adjoining end frames 100 and/or burner end frames 510 and/or refrigerator channels 310, or other components. The refrigerator module 300 comprises a plurality of refrigerator channels 310, which serve to space the end frames 100 (of the adjoining modules) apart, such that an item may be placed flat on the flooring (or ground or decking or patio) surface, with an opening to the front of the apparatus in the refrigerator module 300 that is unobstructed, such that the item's door or doors may open without hindrance by framing components of the modules of the present invention. Such an item may be a refrigerator, an ice maker, a freezer, a chiller for wine or beer, or other desired object that requires an unobstructed front opening in order to operate.

Figure 27:
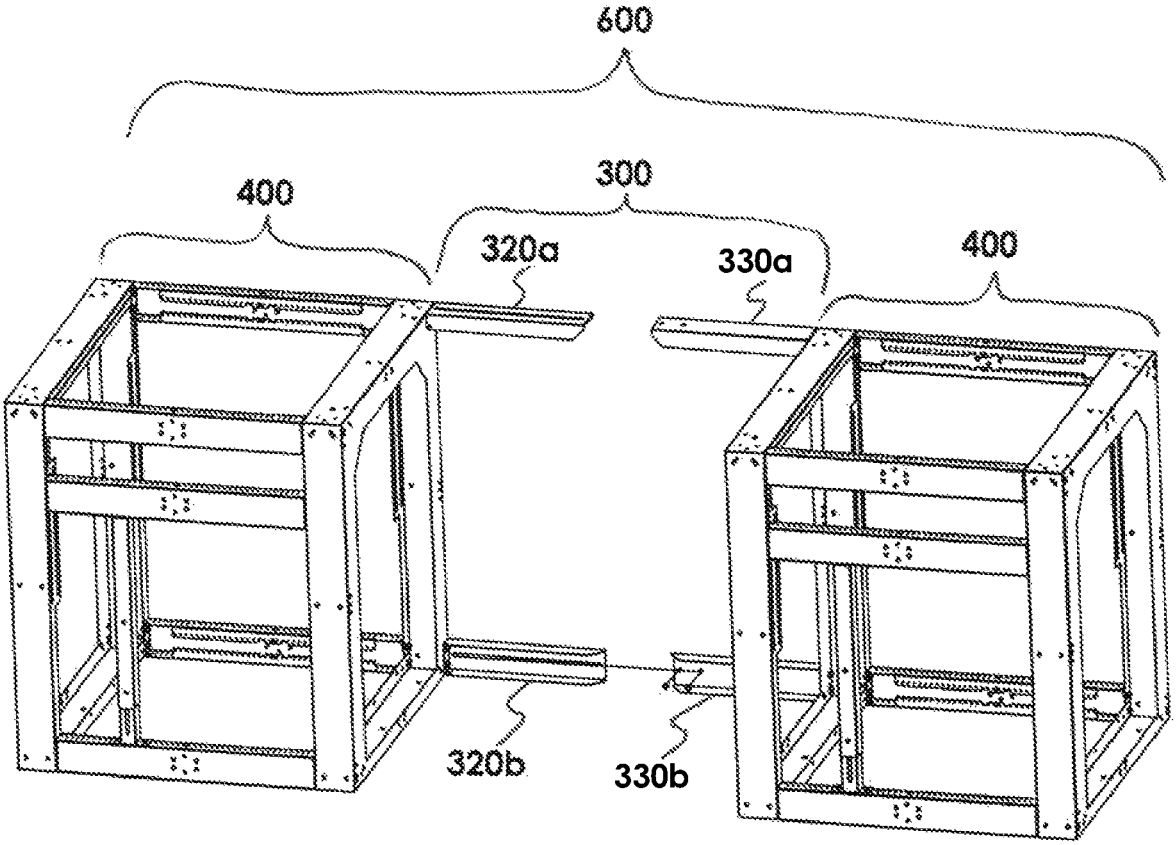
FIG. 27 shows a front perspective view of the exploded components of a refrigerator module between two assembled fixed-width modules.
Figure 28:
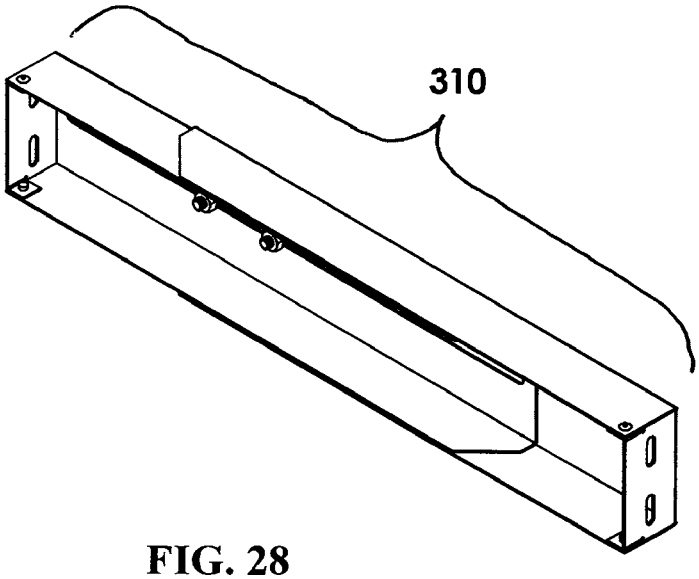
FIG. 28 shows a bottom perspective view of an assembled refrigerator channel.
Figure 29:
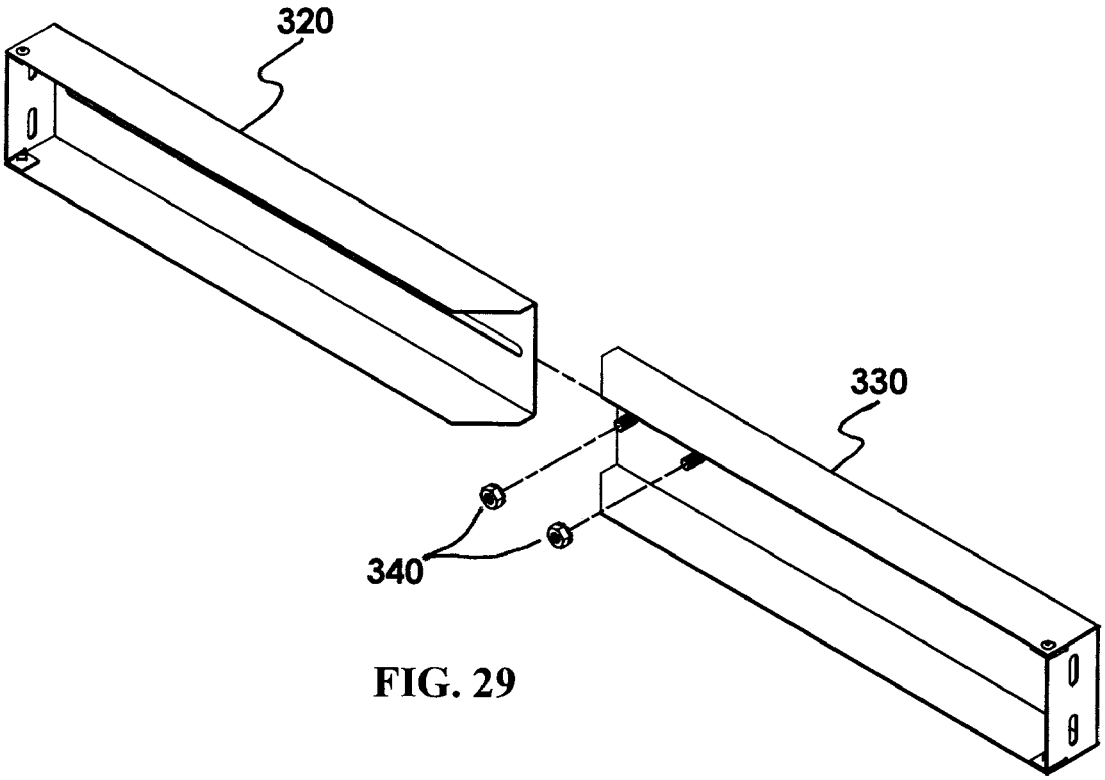
FIG. 29 shows an exploded bottom perspective view of a refrigerator channel.
Figure 30:
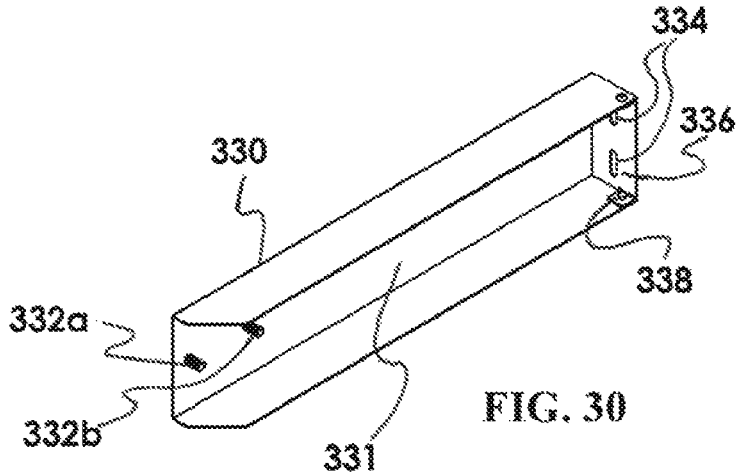
FIG. 30 shows a bottom perspective view of a refrigerator channel locking side.
Figure 31:
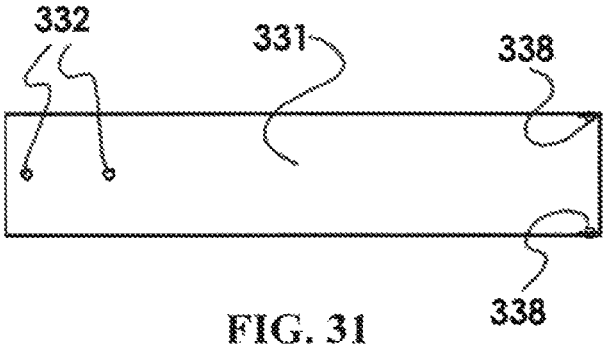
FIG. 31 shows a bottom elevation view of a refrigerator channel locking side.
Figure 32:
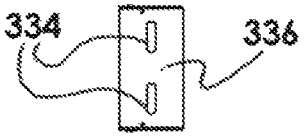
FIG. 32 shows an end elevation view of a refrigerator channel locking side.
Figure 33:
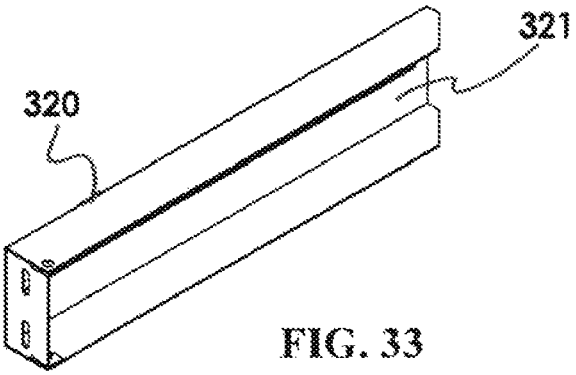
FIG. 33 shows a bottom perspective view of a refrigerator channel slotted side.
Figure 34:
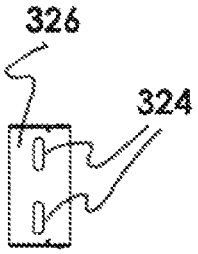
FIG. 34 shows an end elevation view of a refrigerator channel slotted side.
Figure 35:
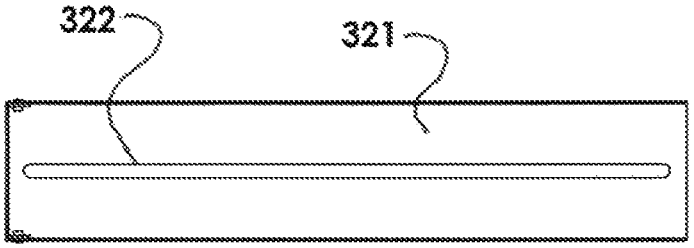
FIG. 35 shows a bottom elevation view of a refrigerator channel slotted side.

FIG. 27 presents a front perspective view of a partially-exploded embodiment of the apparatus of the present invention, in which a refrigerator module 300 is presented as not assembled fully, and in which the component refrigerator channels 310 of the refrigerator module 300 are shown as attached to the plurality of end frames 100, of the fixed-width modules 400, adjoining the refrigerator module 300. The fixed-width modules 400 are shown assembled in FIG. 27, and described more fully below.

COMPONENT: refrigerator channel 310

In this embodiment of a refrigerator module 300, the refrigerator module 300 comprises two refrigerator channels 310, which are labeled as a first refrigerator channel 310*a* and a second refrigerator channel 310*b* in FIG. 26. With reference to FIGS. 28, 29, 30, 31, 32, 33, 34, and 35, each refrigerator channel 310 comprises a refrigerator channel slotted side 320 and a refrigerator channel locking side 330. When the refrigerator channel slotted side 320 and the refrigerator channel locking side 330 are used in a refrigerator module 300, they will be elements of a first refrigerator channel 310*a* and a second refrigerator channel 310*b*, and may be referred to as a first refrigerator channel slotted side 320*a* and a first refrigerator channel locking side 330*a*, and as a second refrigerator channel slotted side 320*b* and a second refrigerator channel locking side 330*b*, as in FIG. 27.

A refrigerator channel 310 is assembled by passing the plurality of refrigerator channel locking bolts 332 (which may be referred to as a first refrigerator channel locking bolt 332*a* and a second refrigerator channel locking bolt 332*b*), which are affixed to the refrigerator channel locking underside 331, through the refrigerator channel slot 322, which is formed as an elongated void in the refrigerator channel slotted underside 321, then adjusting the refrigerator channel 310 to a desired width so as to accommodate the refrigerator or other item, and then securing the refrigerator channel slotted side 320 to the refrigerator channel locking side 330 by affixing a plurality of refrigerator channel nuts 340 to the plurality of refrigerator channel locking bolts 332. Where more than one refrigerator channel 310 is to be used, will be understood by one of skill in the art that all of the refrigerator channels 310 should be adjusted to the same length.

A refrigerator channel 310 may be attached to other modules of the present invention, by affixing though a plurality of refrigerator channel locking distal face slots 334 in a refrigerator channel locking distal face 336, and to the adjoining end frame 100 or burner end frame 510 of the module adjoining the refrigerator module 300. Similarly, the refrigerator channel 310 may be attached to the modules of the present invention on the other side of the refrigerator module 300, by affixing though a plurality of refrigerator channel slotted distal face slots 324 in a refrigerator channel slotted distal face 326, and to the adjoining end frame 100 or burner end frame 510 of the module adjoining the refrigerator module 300. Each such refrigerator channel 310 may be formed, as with other components described above, from sheet metal or other materials, and folded into an appropriately sized and dimensioned object for serving the purposes of the present invention. The elements of this and other components may be fastened into their desired shapes using fasteners, such as the refrigerator channel fasteners 338.

It will be understood by one of skill in the art that the length of the plurality of refrigerator channels 310 used in a particular installation of an apparatus of the present invention can and should be varied to accommodate a refrigerator, ice maker, or other item desired, and be within the scope of the present invention. Likewise, it will be understood by one of skill in the art that a different number of refrigerator channels 310 may be used, other than two refrigerator channels 310, to provide bracing or support and the required spacing for the refrigerator, ice maker, or other item desired. It has been found advantageous to have the plurality of refrigerator channels 310 placed along the back of the end frames 100 adjoining the refrigerator module 300, as shown in FIGS. 26 and 27, so as to maximize the space available for the refrigerator, ice maker, or other item desired, while not interfering with the opening of its door or its placement on the ground or floor surface. As presented in this present disclosure, a refrigerator module 300 must be placed between two other modules so that the plurality of refrigerator channels 310 may be secured at both ends. Other embodiments of the present invention may be possible for attachment of the plurality of refrigerator channels 310 of a refrigerator module 300, such as a freestanding end frame 100, an end frame 100 attached to another structure, or direct attachment of the plurality of refrigerator channels 310 of the refrigerator module 300 to another surface.

MODULE: fixed-width module 400.

Figure 36:
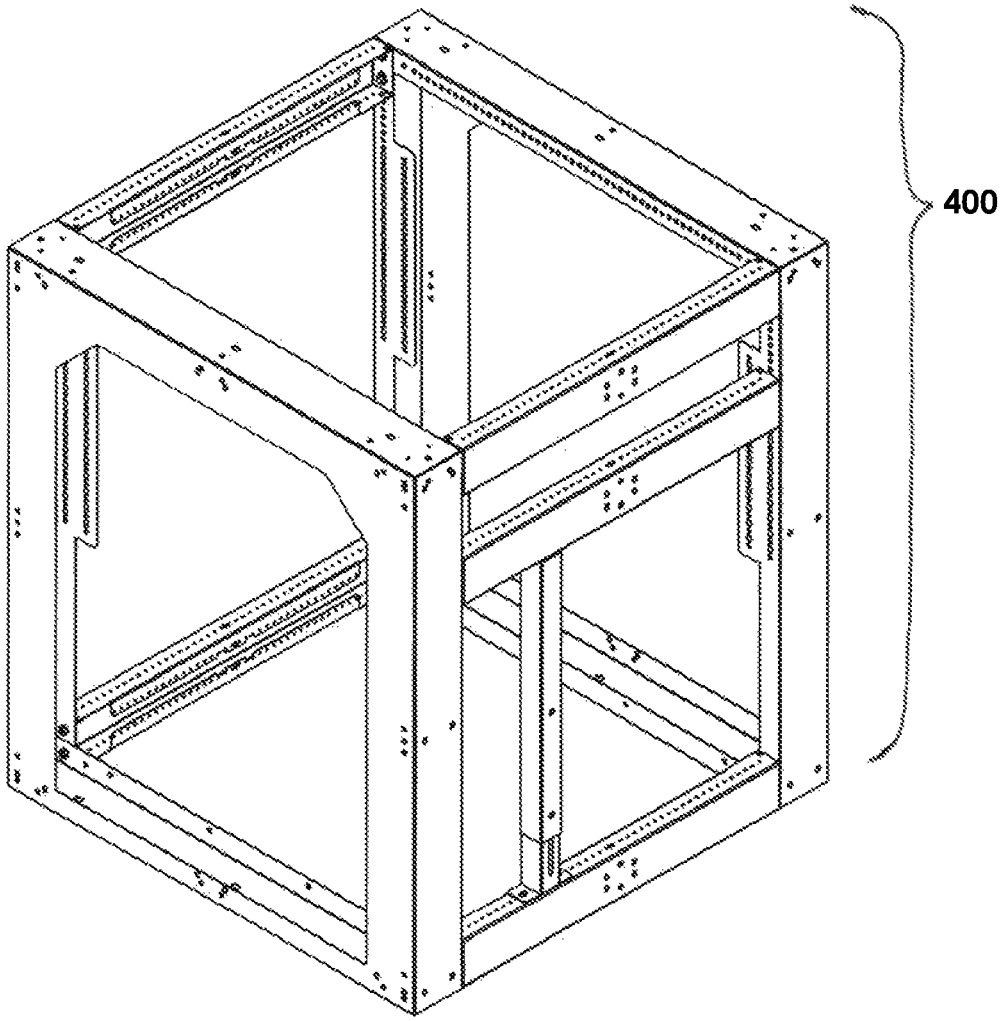
FIG. 36 shows a front perspective view of an assembled fixed-width module.
Figure 37:
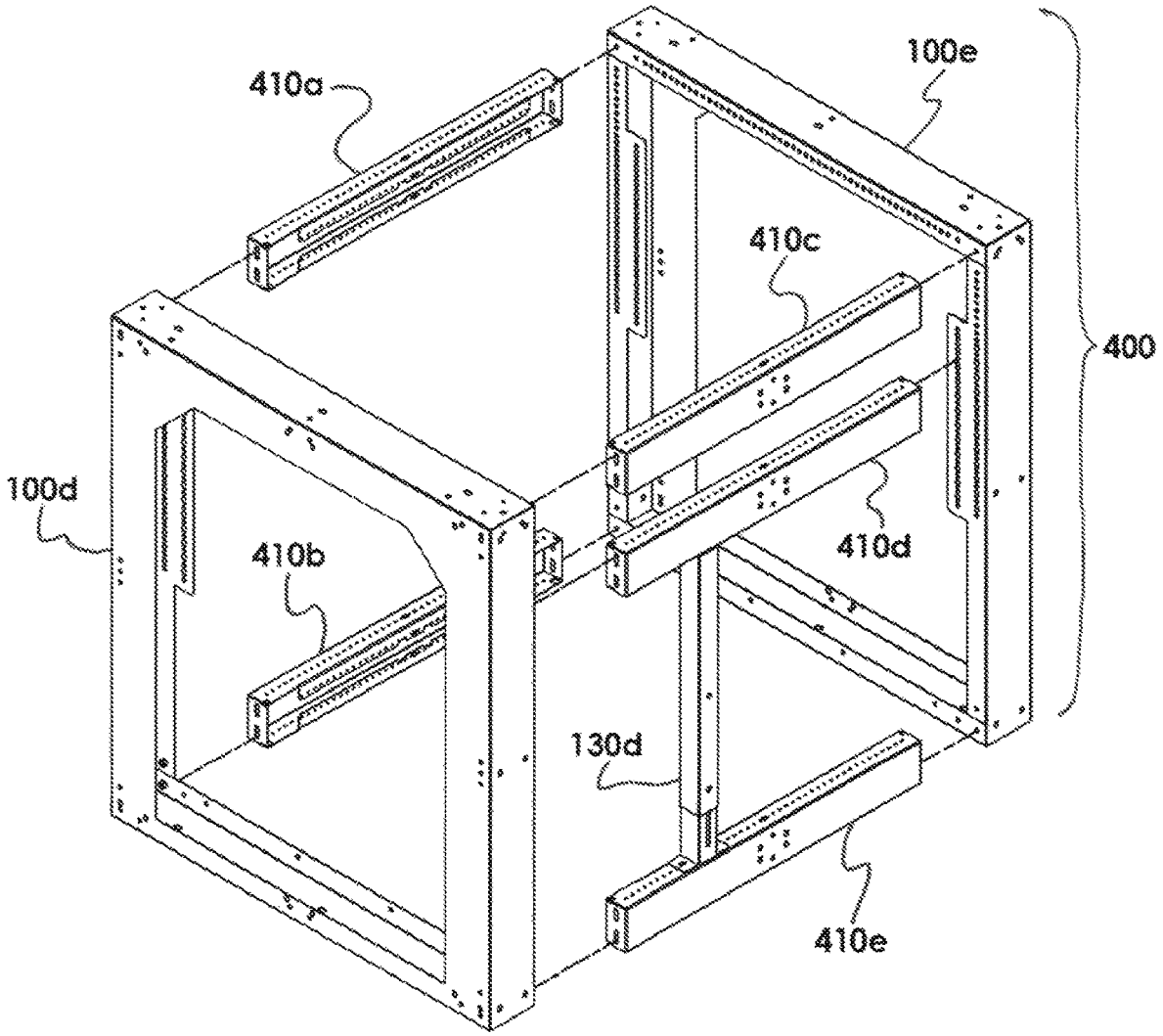
FIG. 37 shows an exploded front perspective view of a fixed-width module.
Figure 38:
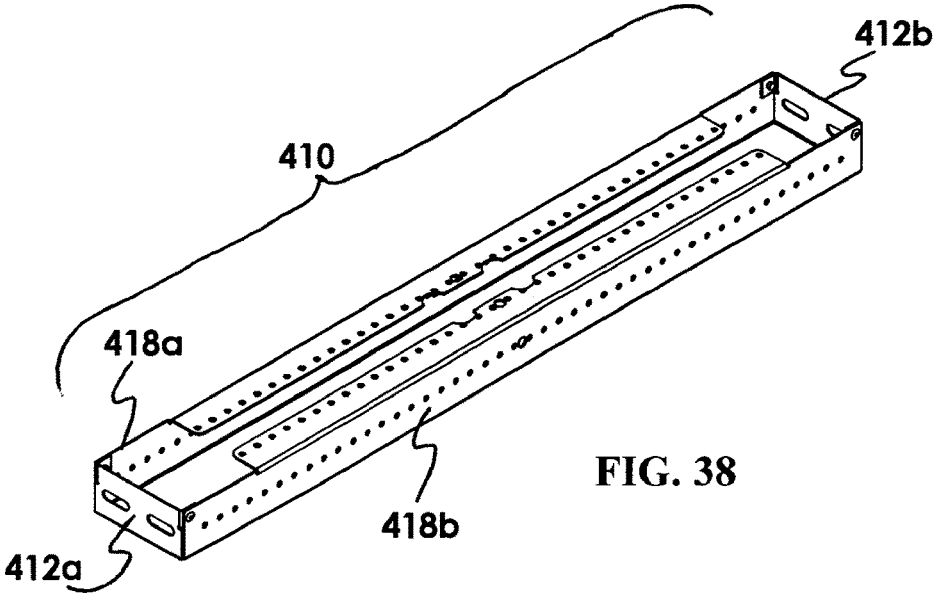
FIG. 38 shows a bottom perspective view of a fixed-width horizontal channel.
Figure 39:
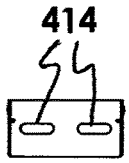
FIG. 39 shows an end elevation view of a fixed-width horizontal channel.
Figure 40:
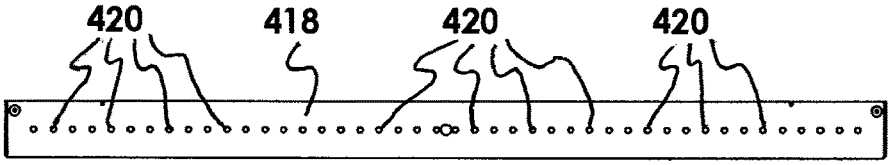
FIG. 40 shows a side elevation view of a fixed-width horizontal channel.
Figure 41:
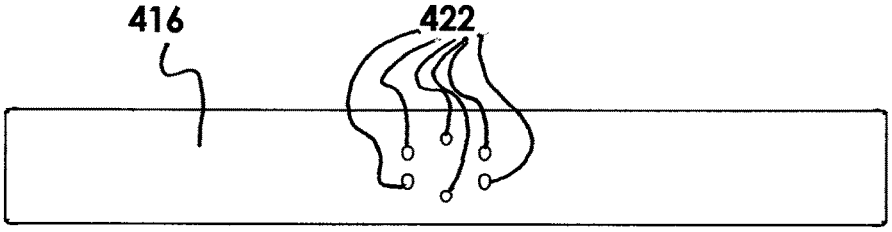
FIG. 41 shows a top elevation view of a fixed-width horizontal channel.

With reference to FIGS. 36 and 37, the inventive apparatus may include a fixed-width module 400. It will be apparent to one of skill in the art that a fixed-width module 400 may be manufactured with components to create multiple fixed-width modules 400, at a range of widths, which widths may be chosen to fit a range of installed finishes and devices, as desired by the person assembling or ordering the products. For instance, without limiting the foregoing, a 24" wide fixed-width module 400 may be selected for serving as the framing for a set of drawers, or a 42" wide fixed-width module 400 may be selected for serving as the framing for a set of shelves. Unlike a grill module 10 or a refrigerator module 300, a fixed-width module 400 is not adjustable as to the overall width of the particular fixed-width module 400. Rather, a plurality of fixed-width modules 400 may be manufactured, sold, and shipped, that is, the components to make up a plurality of fixed-width modules 400 of various widths may be manufactured, so as to allow installers or consumers to choose and customize the installation of the apparatus of the present invention. A fixed-width module 400 comprises, it has been found advantageous, a small number of distinct components which may be used in various combinations and positions to create the fixed-width module 400, or which components may be assembled and/or configured to make other modules of custom cabinetry framing, or used as framing for non-cabinetry purposes. The fixed-width module 400 comprises a plurality of end frames 100, a plurality of fixed-width horizontal channel 410, and a plurality of adjustable narrow channels 130, collectively referred to as components in the present disclosure, as well as fasteners to hold these components together.

With reference to FIG. 37, a front exploded perspective view of an exemplary fixed-width module 400, a particular fixed-width module 400 may comprise a first end frame 100*d*, a second end frame 100*e*, a first fixed-width horizontal channel 410*a*, a second fixed-width horizontal channel 410*b*, a third fixed-width horizontal channel 410*c*, a fourth fixed-width horizontal channel 410*d*, a fifth fixed-width horizontal channel 410*e*, and an adjustable narrow channel 130*d*. The exact number of adjustable narrow channels 130 that is needed may vary from installation to installation of the apparatus of the present invention, as the adjustable narrow channels 130 serve as vertical supports or attachment points, if needed, for the finish or functional item to be installed in the fixed-width module 400, such as a door stopper, or attachment points for shelves or for drawer slides. Each adjustable narrow channel 130, such as adjustable narrow channel 130*d* in FIG. 37, may be adjusted for height, as shown in FIG. 37 to span from the fourth fixed-width horizontal channel 410*d* to the fifth fixed-width horizontal channel 410*e*, and as described previously herein, to accommodate finishes and installed items, as previously described. Each adjustable narrow channel 130, such as adjustable narrow channel 130*d* in FIG. 37, may be placed and attached to the relevant fixed-width horizontal channels 410, so as to provide a lateral support for the desired finishes and/or installed items, such as drawer slides or shelves, as previously described. For some uses of a fixed-width module 400, such as an especially wide fixed-width module 400, it may be desirable to place a plurality of adjustable narrow channels 130, to provide lateral support required for the desired finishes and/or installed items.

For a particular fixed-width module 400 with a particular width, all the fixed-width horizontal channels 410 should be of the same or very nearly the same dimensions, so that together they hold and secure the plurality of end frames 100 in very nearly parallel positions, to make the fixed-width module 400. A range of sizes of fixed-width horizontal channel 410 are possible, to create fixed-width modules 400 of various widths.

COMPONENT: fixed-width horizontal channel 410

Regardless of the overall size of a particular fixed-width horizontal channel 410, each fixed-width horizontal channel 410 comprises, with reference to FIGS. 38, 39, 40, and 41, a first fixed-width horizontal channel side 418*a*, a second fixed-width horizontal channel side 418*b* (either of which may be referred to generically as a fixed-width horizontal channel side 418), a first fixed-width horizontal channel end face 412*a*, a second fixed-width horizontal channel end face 412*b* (either of which may be referred to generically as a fixed-width horizontal channel end face 412), a plurality of fixed-width horizontal channel end face slots 414, a plurality of fixed-width horizontal channel side holes 420, a fixed-width horizontal channel top 416, and a plurality of fixed-width horizontal channel top holes 422. Each of the plurality of fixed-width horizontal channels 410 may be attached to each of the plurality of end frames 100, using the plurality of fixed-width horizontal channel end face slots 414 in each of the relevant fixed-width horizontal channel end faces 412, with the relevant such one being the one closer to and in contact with a particular end frame 100, using any of the plurality of holes or fasteners in the inside faces 167 of the end frames 100, as described previously in the discussion of the grill module 10. For any particular fixed-width module 400, the plurality of fixed-width horizontal channels 410 will be attached to the first end frame 100*d* and to the second end frame 100*e*, along with any desired adjustable narrow channels 130 such as adjustable narrow channel 130*d*, to make the particular fixed-width module 400. Each plurality of fixed-width horizontal channel side holes 420 may be used to attach a finish surface or subsurface, as described previously in discussions of the plurality of adjustable horizontal channels 120, and similarly, the plurality of fixed-width horizontal channel top holes 422 may be used to attach a finish surface or subsurface. Either or both of the plurality of fixed-width horizontal channel side holes 420 and/or the plurality of fixed-width horizontal channel top holes 422, of any of the plurality of fixed-width horizontal channels 410, may be used to attach desired finishes and/or installed items, such as drawer slides or shelves, as previously described.

MODULE: power burner module 500.

Figure 42:
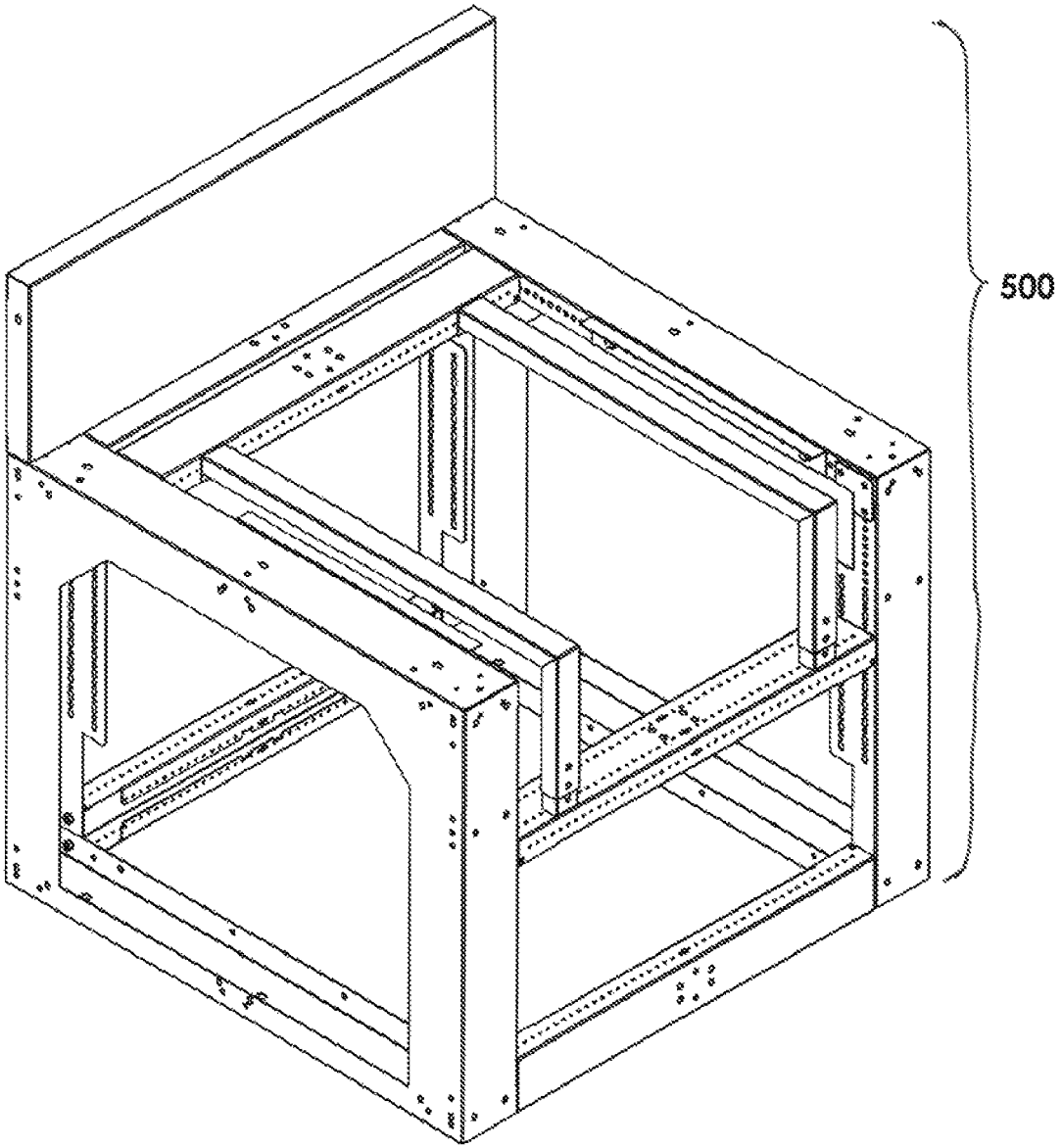
FIG. 42 shows a front perspective view of a power burner module.
Figure 43:
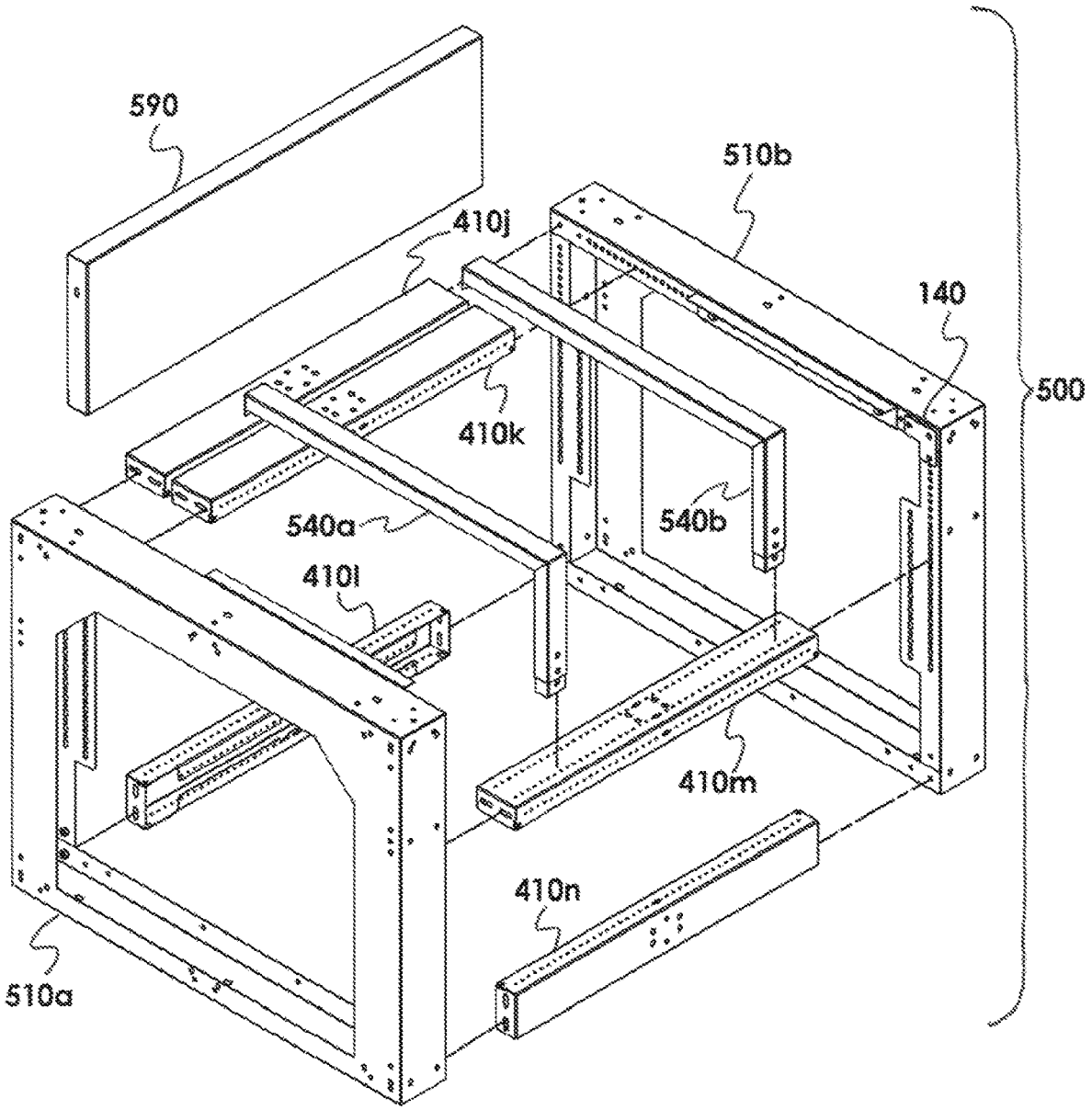
FIG. 43 shows a front exploded perspective view of a power burner module.
Figure 44:
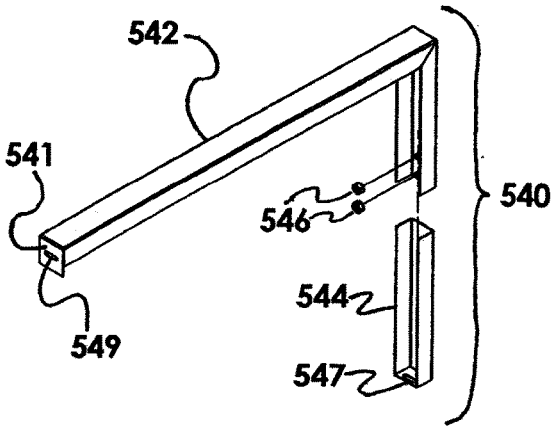
FIG. 44 shows a side exploded perspective view of a burner support L-bracket.
Figure 45:
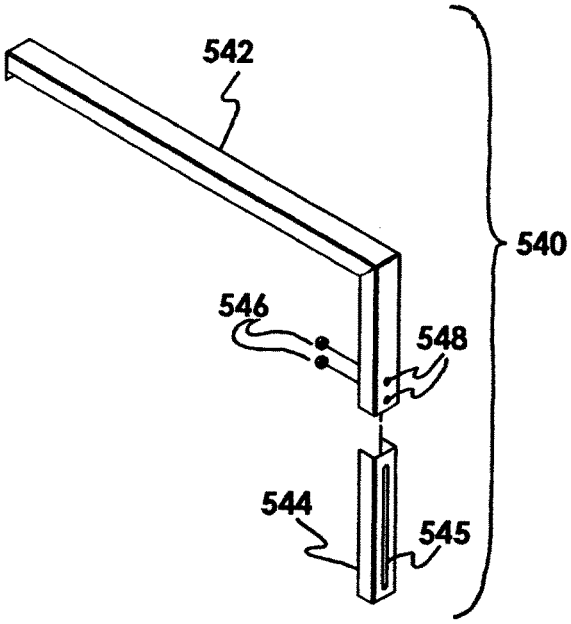
FIG. 45 shows a front exploded perspective view of a burner support L-bracket.
Figure 46:
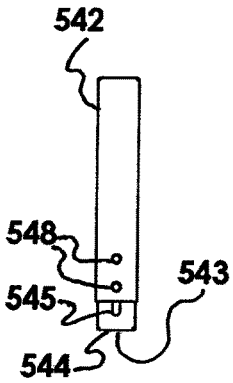
FIG. 46 depicts a front elevation view of an assembled burner support L-bracket.
Figure 47:
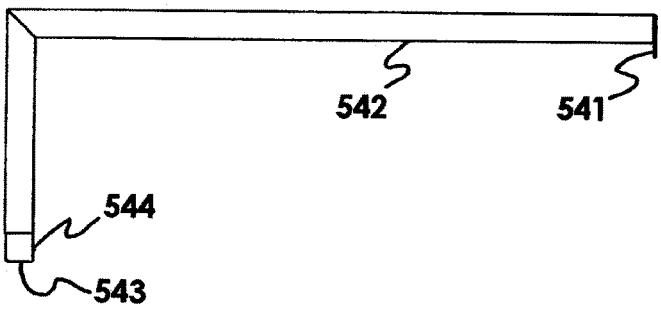
FIG. 47 shows a side elevation view of an assembled burner support L-bracket.
Figure 48:
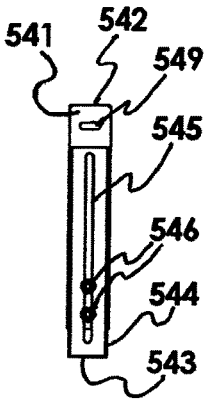
FIG. 48 shows a rear elevation view of an assembled burner support L-bracket.
Figure 49:
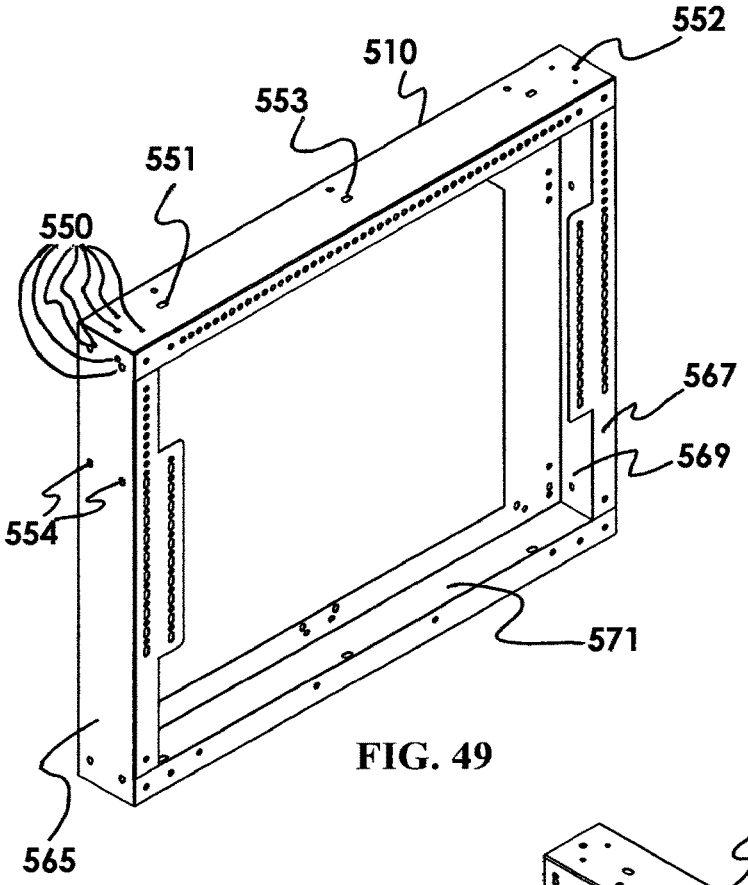
FIG. 49 depicts a side perspective view of a power burner end frame.
Figure 50:
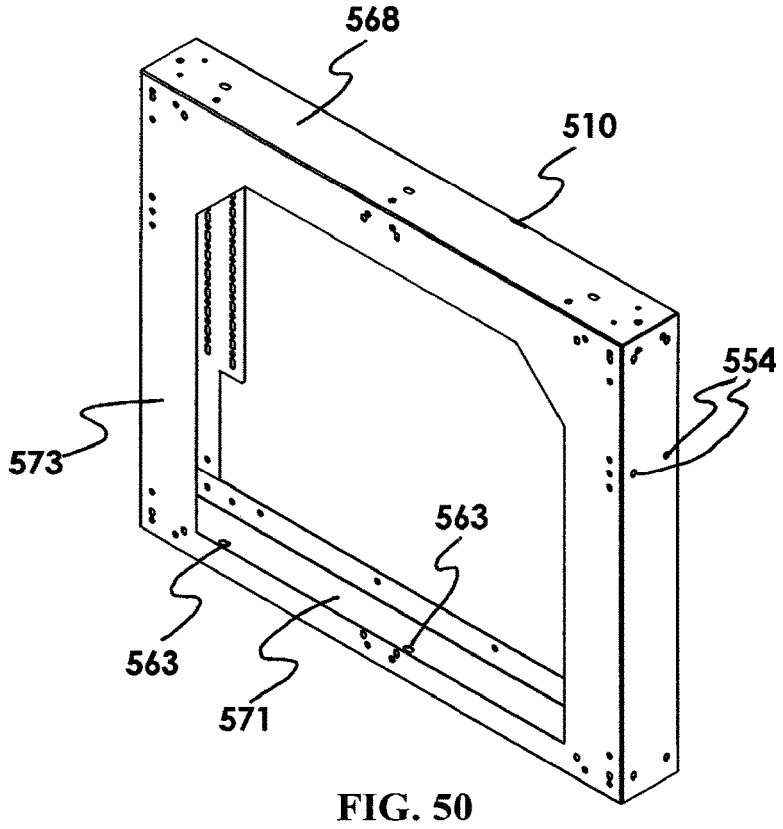
FIG. 50 depicts a front perspective view of a power burner end frame.
Figure 51:
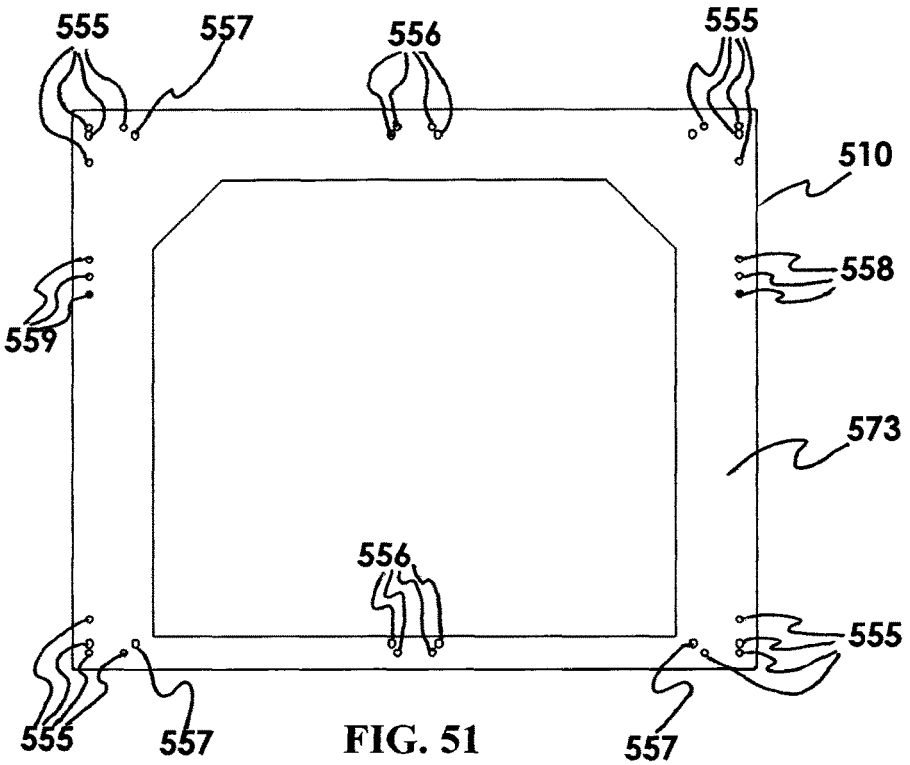
FIG. 51 shows a side elevation view of a power burner end frame, of the outside face.
Figure 52:
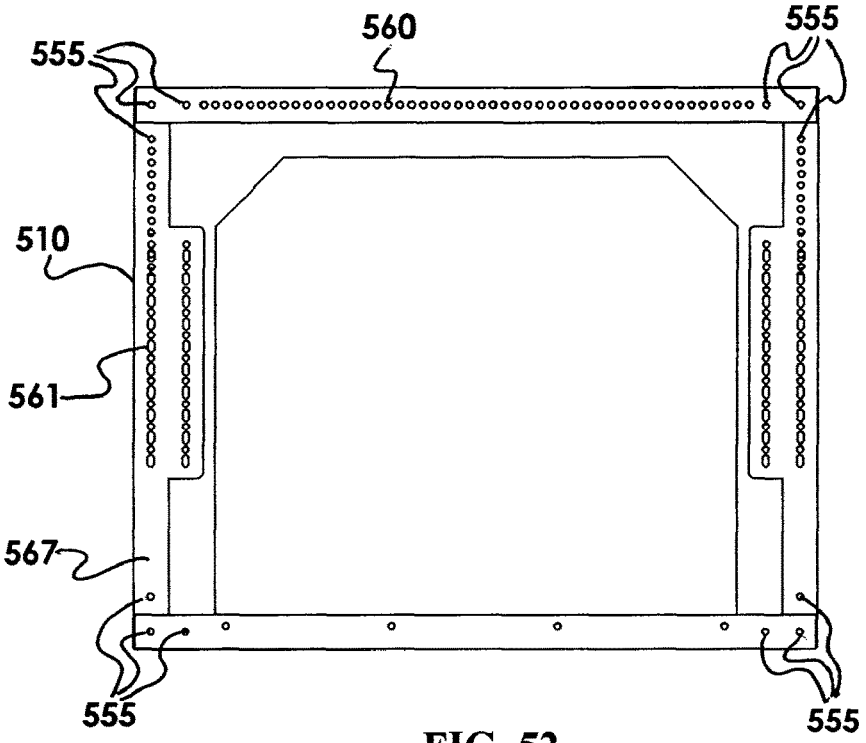
FIG. 52 shows a side elevation view of a power burner end frame, of the inside face.

With reference to FIGS. 42 and 43, the inventive apparatus may comprise a power burner module 500 which may be adjusted at time of assembly to fit a range of power burners or other stovetop or burner assemblies, of varying width, height, and depth. The power burner module 500 comprises, it has been found advantageous, a small number of distinct components which may be used in various combinations and positions to create the power burner module 500, or which components may be assembled and/or configured to make other modules of custom cabinetry framing, or used as framing for non-cabinetry purposes.

With reference to FIGS. 42 through 52, the components comprising a power burner module 500 comprise a plurality of burner end frames 510, a plurality of burner support L-brackets 540, a plurality of fixed-width horizontal channels 410, a plurality of corner braces 140, and a burner backsplash 590. The width (the longest dimension) of the plurality of fixed-width horizontal channels 410 should all be the same for each of the fixed-width horizontal channels 410 used in a particular power burner module 500, though the width used may vary from one power burner module 500 to another, such as 24", 30", or 36", provided as examples without limiting other possible overall widths of the fixed-width horizontal channels 410 or of the power burner module 500. In other embodiments of the present invention, a power burner module 500 may be made with a plurality of adjustable horizontal channels 120 instead of a plurality of fixed-width horizontal channels 410.

COMPONENT: burner end frames 510

With reference to FIG. 42 and FIG. 43, each of the first burner end frame 510*a* and the second burner end frame 510*b* is identical, so that either the first burner end frame 510*a* and the second burner end frame 510*b* may be used on the left or right side of the power burner module 500. With reference to FIGS. 49, 50, 51, and 52, each of the plurality of burner end frames 510 comprises a first lateral side 565, a second lateral side 569, a bottom side 571, an inside face 567, a top side 568, and an outside face 573. The aforementioned sides of each of the plurality of burner end frames 510 are roughly or exactly parallel or perpendicular to each other (with the inside face 567 and outside face 573 parallel to each other, the first lateral side 565 and second lateral side 569 parallel to each other, and the top side 568 and bottom side 571 parallel to each other, and each such pair of parallel sides perpendicular to the other sides), such that each of the plurality of burner end frames 510 comprises the shape of a hollow rectangular solid, with openings in some of the sides. To be used to make a power burner module 500, each of the plurality of burner end frames 510 should be oriented with the top side 568 up and the inside face 567 facing the other of the plurality of burner end frames 510, as is depicted in FIGS. 42-43. When each of the plurality of plurality of burner end frames 510 is being made, following a similar process to that illustrated for an end frames 100 in FIGS. 24A and 24B, each of the plurality of burner end frames 510 may be made from a single sheet of material that is cut and punched with one or more pluralities of holes or slots, making multiple folds of the single sheet of material.

Each of the plurality of burner end frames 510 further comprises a plurality of counter support brace mounting holes 550, a first plurality of back splash unit mounting holes 551, a second plurality of back splash unit mounting holes 552, a plurality of countertop mounting holes 553, a first plurality of bar top support brace mounting holes 554, a first plurality of horizontal channel mounting holes 555, a second plurality of horizontal channel mounting holes 556, a second plurality of bar top support brace mounting holes 557, a third plurality of bar top support brace mounting holes 558, a third plurality of horizontal channel mounting holes 559, a fourth plurality of horizontal channel mounting holes 560, a fifth plurality of horizontal channel mounting holes and slots 561, and a plurality of end frame attachment holes 563; all of which pluralities of mounting holes are collectively referred to herein for simplicity as the burner end frame mounting holes, without conflating their separate nature or uses. The aforementioned pluralities of burner end frame mounting holes in each burner end frame 510 allow each burner end frame 510 to be attached to the other components of the power burner module 500, and to have the rough and/or finish exterior (also referred to as facing, cladding, finishing, or finishes) of the desired cabinetry attached to the power burner module 500 cabinetry framework, including but not limited to cladding, a countertop, a backsplash, the burner or other cooking surface, that is, for any desired finish or hardware on the presently described apparatus.

The plurality of burner end frames 510 are, it has been found advantageous, made to be shorter in height than other end frames 100, as described previously in the present disclosure. The burner end frames 510 are made to be shorter because, when assembled into a power burner module 500, the power burner module 500 is intended to be useable to boil large pots of water, or to cook other large or heavy pots or pans. Accordingly, end users may be lifting heavy pots onto the top surface of a cooking surface (a burner or stovetop), at the top of the power burner module 500. As the end frames 100 described herein are contemplated as being approximate 36" high, it may be uncomfortable, difficult, and/or unsafe for many users to be lifting heavy and/or hot cookware up to or down from a cooking surface at that height, and it may also be impractical for some users to see into and/or cook in a tall item of cookware that is on a cooking surface 36" above the ground or floor level. For instance, without limiting the foregoing, a 20-quart lobster pot or stock pot may be about 13" or 14" high, and will weigh over 20 lbs. if it contains 10 quarts of water. If the cook surface is 36" high, that places the top of the pot at over 48" high—which would present a challenge to use for many users. Lifting it up onto the cook surface may also present a challenge, and taking down a pot of hot water from that height may present a hazard to users, and limit the commercial acceptance and use of such a cooking surface. Accordingly, the present invention provides shorter burner end frames 510 so that the cooking surface is lower than the top surface of other modules of the present invention. It has been found advantageous to have the burner end frames 510 be approximately 24" high, and the end frames 100 be 36" high, though of course other dimensions are possible and may be desirable.

COMPONENT: burner backsplash 590

The burner backsplash 590 is, advantageously, a rectangular prism made from folded material, advantageously, as other components described herein may be. The burner backsplash 590 may, it has been found advantageous, be sized so that its height plus the height of the burner end frames 510 is approximately equal to the height of the end frames 100. This allows for a finish backsplash or other finishing surface to be mounted continuously along the top surfaces of the various modules of the present invention used in a particular assembly and installation of the present invention. Such finishing surfaces may be countertop-style surfaces for most or all of the assembly and installation, located on top of one or more of the assembled modules of the present invention, covering such modules with an approximately horizontal surface, and/or may be a finish backsplash, located at the top and back edge of the modules, or on top of and at the back of any finishing countertop, and oriented to provide an approximately vertical surface at the back of the overall assembly of the present invention. The burner backsplash 590 may, it has been found advantageous, be sized so that its width is approximately equal to the width of the plurality of burner end frames 510 used in the power burner module 500, plus the width of the plurality of fixed-width horizontal channels 410 used in the power burner module 500, so that the burner backsplash 590 provides a continuous support, along the back edge of the particular assembly and installation of the present invention, for any finish surfaces or finish backsplash, as described above. If a power burner module 500 were made with a plurality of adjustable horizontal channels 120, the burner backsplash 590 would need to be made to be adjustable as well, as will be understood by one of skill in the art.

In the exemplary power burner module 500 shown in FIG. 43, the plurality of fixed-width horizontal channels 410 comprises five fixed-width horizontal channels 410: a first fixed-width horizontal channel 410*j*, a second fixed-width horizontal channel 410*k*, a third fixed-width horizontal channel 410*l*, a fourth fixed-width horizontal channel 410*m*, and a fifth fixed-width horizontal channel 410*n*. It will be understood by one of skill in the art that other numbers of fixed-width horizontal channels 410 are possible. The plurality of fixed-width horizontal channels 410 are advantageously attached to the burner end frames 510 (here, a first burner end frame 510*a* and a second burner end frame 510*b*) using fasteners, similarly to how other components are attached together, as described elsewhere in the present disclosure. The placement of the plurality of burner end frames 510 should, it has been found advantageous, be approximately as shown in FIG. 42 and FIG. 43: with the first fixed-width horizontal channel 410*j* attached to the first burner end frame 510*a* and to the second burner end frame 510*b* at their inside top rear corners; the third fixed-width horizontal channel 410*l* attached to the first burner end frame 510*a* and to the second burner end frame 510*b* at their inside bottom rear corners; and the fifth fixed-width horizontal channel 410*n* attached to the first burner end frame 510*a* and to the second burner end frame 510*b* at their inside bottom front corners. A corner brace 140 is attached to the first burner end frame 510*a* and to the second burner end frame 510*b* at their inside top front corners, to provide bracing and support as the corner braces 140 do with other end frames 100, where needed and described herein. This assembly of the present invention discloses the non-adjustable framework of a power burner module 500.

A power burner module 500 is internally adjustable, to accommodate a range of burners or stovetops, which have various heights, widths, and depths, so that the power burner module 500 of the present invention may be used with nearly any existing or desired burner or stovetop. The present invention provides this internal adjustability through the use and variable placement of the second fixed-width horizontal channel 410*k*, the fourth fixed-width horizontal channel 410*m*, and the plurality of burner support L-brackets 540. The placement and use of the plurality of burner support L-brackets 540 will be described below in greater detail. To adjust the opening for the receipt and support of the desired burner or stovetop, the second fixed-width horizontal channel 410*k*, the fourth fixed-width horizontal channel 410*m*, and the plurality of burner support L-brackets 540 may be placed and adjusted. The second fixed-width horizontal channel 410*k* may be moved forward or backward between the inside face 567 of the first burner end frame 510*a* and the inside face 567 of the second burner end frame 510*b*, flush with the top sides 568 of each of the plurality of burner end frames 510, and attached to the plurality of burner end frames 510 using the fourth plurality of horizontal channel mounting holes 560 of each burner end frame 510, to provide support for the rear edge of the desired burner or stovetop.

The fourth fixed-width horizontal channel 410*m* may be moved up and down between the inside face 567 of the first burner end frame 510*a* and the inside face 567 of the second burner end frame 510*b*, and flush with first lateral side 565 of the first burner end frame 510*a* and the second lateral side 569 of the second burner end frame 510*b*, those lateral sides being the sides oriented towards the front of the respective burner end frames 510, and attached to the respective burner end frames 510 using the fifth plurality of horizontal channel mounting holes and slots 561 of each of the burner end frames 510, to provide bracing for the plurality of burner support L-brackets 540 at the appropriate depth of the desired burner or stovetop, and possibly provide support for the desired burner or stovetop from the underside. The plurality of burner support L-brackets 540 may be moved laterally within the other components comprising the power burner module 500, such that the burner support L-brackets 540 are at a width apart from each other that will allow them both to be used to support and attach to the desired burner or stovetop. The plurality of burner support L-brackets 540 may then be attached to the fixed-width horizontal channel side 418 of the second fixed-width horizontal channel 410*k* using the plurality of fixed-width horizontal channel side holes 420 of that fixed-width horizontal channel side 418. The plurality of burner support L-brackets 540 may be adjusted and set for height, described below, to contact the fixed-width horizontal channel top 416 of the fourth fixed-width horizontal channel 410*m*, and attached to the fourth fixed-width horizontal channel 410*m* using plurality of fixed-width horizontal channel top holes 422, which may be clustered in the center of the fixed-width horizontal channel top 416 as labeled in FIG. 41, or may be spread across much of the fixed-width horizontal channel top 416, as depicted in FIG. 42 and FIG. 43. The plurality of burner support L-brackets 540 then provide lateral and vertical support and bracing to the desired burner or stovetop, which may be placed between them and secured to them and/or to other components of the power burner module 500.

COMPONENT: burner support L-bracket 540

With reference to FIGS. 44, 45, 46, 47, and 48, each burner support L-bracket 540 comprises a L-bracket sleeve 542 and a L-bracket slide 544. Each of the L-bracket sleeve 542 and the L-bracket slide 544 may be made from a single sheet of material that is cut and punched with one or more pluralities of holes or slots, and each of the L-bracket sleeve 542 and the L-bracket slide 544 are folded to form hollow rectangular solids. The L-bracket sleeve 542 and the L-bracket slide 544 may, it has been found advantageous, be cut and folded to have only three sides parallel to their long axes: the axes on which they are engaged and can be adjusted to a chosen length, and then secured at that length. This three-sided arrangement for each of the L-bracket sleeve 542 and the L-bracket slide 544, and as shown in FIGS. 44, 45, 46, 47, and 48, provides for sufficient strength to bear the required loads of the burners or cooking surfaces, a sufficient and flush mounting surface for the user's desired finishes, and easy access to the connectors and fasteners used to secure the L-bracket sleeve 542 and the L-bracket slide 544 to each other at the user's chosen and appropriate length, as is described below. The L-bracket sleeve 542 is cut and folded to comprise a 90° angle, shaped like a capital letter "L", and the L-bracket slide 544 engages with the L-bracket sleeve 542 at its shorter end, which is to be mounted vertically, as shown in FIG. 42 and FIG. 43.

The L-bracket sleeve 542 and the L-bracket slide 544 are folded with cross-sectional dimensions such that the L-bracket sleeve 542 may slide freely but snugly over the L-bracket slide 544. By adjusting the amount of overlap of the L-bracket sleeve 542 and the L-bracket slide 544, the length of each burner support L-bracket 540 may be set to accommodate burners or cook surfaces of various heights, when assembling a power burner module 500. When the user or installer assembles any of the plurality of burner support L-brackets 540, the user may choose an appropriate length of each burner support L-bracket 540. That length may then be secured, by fastening the L-bracket sleeve 542 and the L-bracket slide 544 together, utilizing a plurality of L-bracket connectors 548 affixed to and/or made as part of the L-bracket sleeve 542 specifically in the shorter arm of the L-bracket sleeve 542, passed through a L-bracket slide slot 545 which runs most of the length of the L-bracket slide 544, centered in the front face of the L-bracket slide 544, and attached with a plurality of L-bracket fasteners 546. The chosen length of each burner support L-bracket 540 should correspond to the desired height of the burner or cooking surface that is to be attached to and/or installed on and in the top of the power burner module 500. The placement of each burner support L-bracket 540 side-to-side in the power burner module 500 will determine the width of the opening available for any such burner or cooking surface, and should be selected by the user or person assembling the module to properly and securely accommodate the desired hardware. Any power burner module 500 that is assembled with a plurality of burner support L-bracket 540 may have the height of each burner support L-bracket 540 and the spacing between each burner support L-bracket 540 set to accommodate the desired hardware.

The plurality of L-bracket connectors 548 are set through the L-bracket slide slot 545 of the L-bracket slide 544, as shown in FIGS. 44-48. The plurality of L-bracket connectors 548 and the L-bracket slide slot 545 are in the middle faces of their respective components, that is, they are opposite the open faces (where there is no material) of the L-bracket sleeve 542 and the L-bracket slide 544, respectively.

The overall assembly of the burner support L-bracket 540 is then set at a chosen height, and the plurality of L-bracket connectors 548 are then secured with the plurality of L-bracket fasteners 546, securing the L-bracket sleeve 542 and the L-bracket slide 544 to each other, and fixing that burner support L-bracket 540 at the chosen height. It has been found advantageous to have the plurality of L-bracket connectors 548 be press-fit threaded studs and to have the plurality of L-bracket fasteners 546 be lock nuts suited to engage with the plurality of L-bracket connectors 548 securing the L-bracket sleeve 542 and the L-bracket slide 544 to each other, but it will be understood by one of skill in the art that other types of connectors and fasteners suitable for fixedly connecting with each other to secure the L-bracket sleeve 542 and the L-bracket slide 544 to each other, whether those connectors and fasteners are now known or later invented, may also be used.

With reference to FIGS. 44-48, the L-bracket slide 544 further comprises a L-bracket slide mounting foot 543, which is advantageously formed by cutting and/or bending part of the sheet of material of which the L-bracket slide 544 is comprised such that the L-bracket slide mounting foot 543 is perpendicular to the main axis of the L-bracket slide 544. The L-bracket slide mounting foot 543 further comprises a plurality of L-bracket slide mounting slots 547, which are cut or punched through the L-bracket slide mounting foot 543. The plurality of L-bracket slide mounting slots 547 allow each of the burner support L-bracket 540 to be attached securely to other components of the modules of the present invention, such as their attachment to a fixed-width horizontal channel 410, as described in this present disclosure, to form a variety of modules of the present invention.

With reference to FIGS. 44-48, the L-bracket sleeve 542 further comprises a L-bracket sleeve mounting foot 541, which is advantageously formed by cutting and/or bending part of the sheet of material of which the L-bracket sleeve 542 is comprised such that the L-bracket sleeve mounting foot 541 is perpendicular to the long axis of the longer part of the L-bracket sleeve 542, and is to be in a vertical plane when attached as part of a power burner module 500, as illustrated in FIGS. 42-43. The L-bracket sleeve mounting foot 541 further comprises a plurality of L-bracket sleeve mounting slots 549, which are cut or punched through the L-bracket sleeve mounting foot 541. The plurality of L-bracket sleeve mounting slots 549 allow each of the burner support L-brackets 540 to be attached securely to other components of the modules of the present invention, such as to a fixed-width horizontal channel 410, as described in this present disclosure, to form a variety of modules of the present invention.

Certain embodiments of the present invention were described above. From the foregoing it will be seen that this invention is one well adapted to attain all the ends and objects set forth above, together with other advantages, which are obvious in and inherent to the inventive apparatus disclosed herein. It will be understood that certain features and sub-combinations are of utility and may be employed without reference to other features and sub-combinations. It is expressly noted that the present invention is not limited to those embodiments described above, but rather the intention is that additions and modifications to what was expressly described herein are also included within the scope of the invention. Moreover, it is to be understood that the features of the various embodiments described herein are not mutually exclusive and can exist in various combinations and permutations, even if such combinations or permutations were not made express herein, without departing from the spirit and scope of the invention. In fact, variations, modifications, and other implementations of what was described herein will occur to those of ordinary skill in the art without departing from the spirit and the scope of the invention. As such, the invention is not to be defined only by the preceding illustrative description.

What is claimed is:

1. An apparatus of modular flat-pack customizable cabinetry framing, the apparatus comprising a grill module, which grill module comprises components, namely a plurality of end frames, a plurality of adjustable horizontal channels, a plurality of adjustable narrow channels, and a plurality of corner braces; and wherein the plurality of end frames comprises a first end frame and a second end frame; and the plurality of adjustable horizontal channels comprises a first adjustable horizontal channel, a second adjustable horizontal channel, a third adjustable horizontal channel, a fourth adjustable horizontal channel, a fifth adjustable horizontal channel, and a sixth adjustable horizontal channel; and the plurality of adjustable narrow channels comprises a first adjustable narrow channel and a second adjustable narrow channel; and the plurality of corner braces comprises a first corner brace and a second corner brace;

and wherein the plurality of end frames comprise inside faces and each of the inside faces comprises four corners, and each of the plurality of corner braces is used to brace a corner of each of the inside faces of the plurality of end frames;

and wherein three of the plurality of adjustable horizontal channels connect the inside faces of the plurality of end frames at the three of the four corners of the inside faces of the plurality of end frames where the plurality of corner braces is not used;

and wherein the components are made of sheet materials that are cut, punched, and/or folded.

* * * * *